US005681507A

United States Patent [19]

Kazuma

[11] Patent Number: 5,681,507

[45] Date of Patent: Oct. 28, 1997

[54] APPARATUS FOR MANUFACTURING CARBONATED WATER

[75] Inventor: Yasuo Kazuma, Ohsato-gun, Japan

[73] Assignee: Sanyo Electric Co., Ltd., Osaka-fu, Japan

[21] Appl. No.: 655,058

[22] Filed: May 29, 1996

[30] Foreign Application Priority Data

| | | | |
|---|---|---|---|
| May 30, 1995 | [JP] | Japan | 7-154133 |
| May 30, 1995 | [JP] | Japan | 7-154134 |
| May 31, 1995 | [JP] | Japan | 7-157185 |
| May 31, 1995 | [JP] | Japan | 7-157186 |
| May 31, 1995 | [JP] | Japan | 7-157187 |

[51] Int. Cl.[6] ..... B01F 3/04

[52] U.S. Cl. ..... 261/27; 261/DIG. 7; 261/119.1

[58] Field of Search ..... 261/119.1, DIG. 7, 261/27

[56] References Cited

U.S. PATENT DOCUMENTS

| | | | |
|---|---|---|---|
| 626,126 | 5/1899 | Zingsem | 261/DIG. 7 |
| 636,162 | 10/1899 | Murphy | 261/DIG. 7 |
| 671,176 | 4/1901 | Bangs | 261/DIG. 7 |
| 706,115 | 8/1902 | Rult | 261/DIG. 7 |
| 722,368 | 3/1903 | Lee et al. | 261/DIG. 7 |
| 871,174 | 11/1907 | Murphy | 261/DIG. 7 |
| 1,272,299 | 7/1918 | Murphy | 261/DIG. 7 |
| 1,516,187 | 11/1924 | Hanson | 261/DIG. 7 |
| 1,525,674 | 2/1925 | Thomas | 261/DIG. 7 |
| 2,217,841 | 10/1940 | Holinger | 261/DIG. 7 |
| 2,339,640 | 1/1944 | Holinger | 261/DIG. 7 |
| 2,588,677 | 3/1952 | Welty et al. | 261/DIG. 7 |
| 2,757,843 | 8/1956 | Smith | 261/DIG. 7 |
| 3,248,098 | 4/1966 | Cornelius | 261/DIG. 7 |
| 3,534,944 | 10/1970 | Pahl et al. | 261/DIG. 7 |
| 3,756,576 | 9/1973 | Tremolada | 261/DIG. 7 |
| 4,068,010 | 1/1978 | Karr | 261/DIG. 7 |
| 4,749,580 | 6/1988 | Demyanovich | 261/DIG. 7 |
| 4,882,097 | 11/1989 | Shannon | 261/DIG. 7 |
| 5,259,997 | 11/1993 | Kazuma | 261/DIG. 7 |

FOREIGN PATENT DOCUMENTS

| | | | |
|---|---|---|---|
| A481384 | 4/1992 | European Pat. Off. . | |
| 410640 | 5/1910 | France | 261/DIG. 7 |
| 486114 | 11/1929 | Germany | 261/DIG. 7 |
| A1517349 | 9/1969 | Germany . | |
| 1816738 | 12/1969 | Germany . | |
| 458045 | 1/1950 | Italy | 261/DIG. 7 |
| 61-164630 | 7/1986 | Japan . | |
| 2043931 | 2/1990 | Japan | 261/DIG. 7 |
| A1047090 | 11/1966 | United Kingdom . | |

*Primary Examiner*—Tim R. Miles

*Attorney, Agent, or Firm*—Lowe, Price, LeBlanc & Becker

[57] ABSTRACT

An apparatus for manufacturing carbonated water according to the invention can quickly produce carbonated water with a high carbonic acid gas content which does not easily lose carbonic acid gas and hence satisfactorily stimulates the throat with agreeable pungency. Since it has a simple configuration and hence is economic and effective, it can suitably be used in an carbonated beverage supplying apparatus such as an automatic vending machine, an automatic dispenser or the like. With such an arrangement, the apparatus improves its safety and hence can constantly supply delicious carbonated water.

4 Claims, 19 Drawing Sheets

APPARATUS FOR MANUFACTURING CARBONATED WATER

BACKGROUND OF THE INVENTION

1. Field of the Invention

This invention relates to an apparatus for manufacturing carbonated water by contact between carbonic acid gas and water and, more particularly, it relates to an apparatus for manufacturing carbonated water that can suitably be used in an carbonated beverage supplying apparatus such as an automatic vending machine, an automatic dispenser or the like.

2. Background Art

With a known method for manufacturing carbonated water disclosed in Japanese Patent Application Laid-Open No. 61-164630, water is injected into a carbonic acid gas pressure container through an orifice arranged at an upper part thereof so that air bubbles formed by the injected water absorb carbonic acid gas to consequently produce carbonated water. However, this known method is accompanied by a drawback that carbonated water manufactured by this method does not satisfactorily stimulate the throat with agreeable pungency because, with this method, carbonic acid gas is absorbed by water that is being injected and vibrating and the absorbed gas can be easily separated again from the water by the temperature of the human body once the carbonated water is taken into the body.

In an attempt to overcome this drawback, there has been proposed a technique of arranging sprays on the peripheral wall of the carbonic acid gas pressure container in order to disperse water and make it fly over a distance that is long enough to sufficiently absorb carbonic acid gas. However, it is not realistic to provide such a long flying distance for water in an apparatus for manufacturing carbonated water that is installed in an automatic vending machine or an automatic dispenser.

There is also proposed a technique of providing a long flying distance for water without using a large apparatus. With this technique, a convex inner wall is arranged vis-a-vis the sprays in the carbonic acid gas pressure container so that sprayed water may collide with the convex wall and become rebounded and dispersed again to consequently prolong the overall flying distance. However, with this technique, water colliding with the convex wall of the pressure container does not rebound satisfactorily because the energy of collision is mostly absorbed by the convex wall and most of the water simply falls along the wall.

With another proposed technique, water is injected into the carbonic acid gas pressure container continuously through a nozzle and made to collide with the inner wall of the container to become atomized. However, again, the energy of collision is mostly absorbed by the wall and, consequently, most of the water simply falls along the wall to make the technique poorly successful.

There is also a known technique of putting cold water into the carbonic acid gas pressure container and stirring it by means of a stirrer to produce bubbles so that the latter may absorb carbonic acid gas. However, when a carbonated water manufacturing apparatus involving the use of such a technique is installed in an automatic vending machine or an automatic dispenser and the apparatus is operated constantly for a long period, the carbonic acid gas contained in the pressure container is rapidly consumed to make the apparatus inoperable within a short period of time.

SUMMARY OF THE INVENTION

In view of the above identified problems, it is therefore the object of the present invention to provide an apparatus for manufacturing carbonated water that can quickly produce carbonated water with a high carbonic acid gas content which does not easily lose carbonic acid gas and hence satisfactorily stimulates the throat with agreeable pungency and that can suitably be used in an carbonated beverage supplying apparatus such as an automatic vending machine, an automatic dispenser or the like.

According to a first aspect of the invention, the above object is achieved by providing an apparatus for manufacturing carbonated water by contact between carbonic acid gas and water introduced into a carbonic acid gas pressure container it comprises, characterized in that it additionally comprises a mixing vessel arranged in the carbonic acid gas pressure container below the inlet port for introducing carbonic acid gas into the carbonic acid gas pressure container and the spray for introducing water into the carbonic acid gas pressure container and having the introduced water collide and become mixed with the water already in the pressure container, said mixing vessel being separated from the inner peripheral wall of the carbonic acid gas pressure container by a gap, in order for the sprayed water to be mixed with the water staying in the mixing vessel and a partition panel having an end rigidly secured to the inner peripheral wall of the carbonic acid gas pressure container and the opposite end extending close to the bottom of the mixing vessel so that the produced carbonated water passes through the gap between the partition panel and the peripheral wall of the mixing vessel and overflows the peripheral wall to flow down through the gap between the inner wall of the carbonic acid gas pressure container and the peripheral wall of the mixing vessel to the bottom of the carbonic acid gas pressure container.

Preferably, the peripheral wall of the mixing vessel extends downward beyond the bottom of the mixing vessel.

With the above arrangement, water is discharged from the spray in the form of fine drops, which absorb carbonic acid gas and collide with the water already in the mixing vessel to produce carbonated water containing therein a huge number of minute bubbles of carbonic acid gas that are well dispersed in the carbonated water. The produced carbonated water then flows through a specific flow path and overflows the lateral wall of the mixing vessel to fully get in touch with and absorb carbonic acid gas as it flows down to the bottom of the carbonic acid gas pressure container so that consequently high quality carbonated water can be obtained.

According to a second aspect of the invention, there is provided an apparatus for manufacturing carbonated water by contact between carbonic acid gas and water introduced into a carbonic acid gas pressure container it comprises, characterized in that it additionally comprises an cylindrical mist chamber arranged in the carbonic acid gas pressure container and having its top and peripheral walls hermetically sealed, said cylindrical mist chamber being provided with a spray at the top for introducing water therein and a semispherical projection having a diameter smaller than the inner diameter of the cylindrical mist chamber at the bottom, a coupling member for connecting said semispherical projection and the peripheral wall of the cylindrical mist chamber, said coupling member being provided with a large number of small holes for allowing water to pass therethrough, and a cylindrical metal network having open top and bottom and arranged under the coupling member so that water drops discharged from the spray collide with the surface of the semispherical projection and are atomized and dispersed in the cylindrical mist chamber to sufficiently get in touch with carbonic acid gas before they flow down through the small holes and the cylindrical metal network to the bottom of the carbonic acid gas pressure container.

Preferably, the cylindrical metal network is so arranged that its lower end is constantly held in contact with the carbonated water in the carbonic acid gas pressure container.

With the above arrangement, water drops discharged from the spray collide with the surface of the semispherical projection and are atomized and dispersed in the cylindrical mist chamber to sufficiently get in touch with and absorb carbonic acid gas before they flow down through the small holes and the cylindrical metal network to wet the latter and further absorb carbonic acid gas until they get to the bottom of the carbonic acid gas pressure container so that consequently high quality carbonated water can be obtained.

If the cylindrical metal network is so arranged that its lower end is constantly held in contact with the carbonated water in the carbonic acid gas pressure container, water containing carbonic acid gas can fall into the carbonated water already contained in the carbonic acid gas pressure container without disturbing the surface of the latter so that consequently high quality carbonated water can be obtained.

While the material of the semispherical projection is not subject to specific limitations, it is preferably selected from materials that would not easily oscillate to absorb the energy of collision generated by water drops colliding with the surface of the semispherical projection. More specifically, if the semispherical projection may suitably be made of polyacetal or made of stainless steel and coated with polyacetal, water drops that are discharged from the spray and collide with the surface of the semispherical projection would not flow down along the surface but become crushed into smaller drops, which would be dispersed into the space of the cylindrical mist chamber to satisfactorily get in touch with and absorb carbonic acid gas.

If water is discharged from the spray with a pressure higher than the predetermined pressure of carbonic acid gas in the carbonic acid gas pressure container by more than 3 $Kg/cm^2$, it is broken into fine drops, which then collide with the surface of the semispherical projection at an appropriate speed and become crushed into smaller drops so that the latter may be dispersed into the space of the cylindrical mist chamber without flowing down along the surface of the semispherical projection to produce high quality carbonated water.

Preferably, a water level control sensor is arranged in the carbonic acid gas pressure container to detect the level of the carbonated water in the pressure container and produce a signal representing the level in order to control the water supply pump of the apparatus by referring to the upper limit water level, the lower limit water level and the critical water level for carbonated water. With such an arrangement, the apparatus improves its safety and hence can constantly supply delicious carbonated water.

According to a third aspect of the invention, there is provided an apparatus for manufacturing carbonated water by contact between carbonic acid gas and water introduced into a carbonic acid gas pressure container it comprises, characterized in that it additionally comprises an cylindrical mist chamber arranged in the carbonic acid gas pressure container and having its top and peripheral walls hermetically sealed, said cylindrical mist chamber being provided with a spray at the top for introducing water therein and a semispherical projection having a diameter smaller than the inner diameter of the cylindrical mist chamber at the bottom, a coupling member for connecting said semispherical projection and the peripheral wall of the cylindrical mist chamber, said coupling member being provided with a large number of small holes for allowing water to pass therethrough, and an appropriate number of linear guide filaments, provided whenever necessary and extending downward from the coupling member, so that water drops discharged from the spray collide with the surface of the semispherical projection and are atomized and dispersed in the cylindrical mist chamber to sufficiently get in touch with carbonic acid gas before they flow down through the small holes and the linear guide filaments to the bottom of the carbonic acid gas pressure container.

Preferably, the linear guide filaments are so arranged that its lower end is constantly held in contact with the carbonated water in the carbonic acid gas pressure container.

With the above described arrangement of apparatus for manufacturing carbonated water, water drops discharged from the spray collide with the surface of the semispherical projection and become crushed into smaller drops, which would be dispersed into the space of the cylindrical mist chamber to satisfactorily get in touch with and absorb carbonic acid gas, and, at the same time, the water that has absorbed carbonic acid gas flows out through the small holes and either goes down to the bottom of the carbonic acid gas pressure container, absorbing carbonic acid gas still further as it is constantly held in touch with the latter, or goes down along the linear guide filaments such as fine metal wires provided whenever necessary, wetting the surface thereof and absorbing carbonic acid gas still further as it is also constantly held in touch with the latter, before it get to the bottom of the carbonic acid gas pressure container as excellently delicious carbonated water.

If the linear guide filaments are so arranged that their lower ends are constantly held in contact with the carbonated water in the carbonic acid gas pressure container, water containing carbonic acid gas can fall into the carbonated water already contained in the carbonic acid gas pressure container without disturbing the surface of the latter so that consequently high quality carbonated water can be obtained.

While the material of the semispherical projection is not subject to specific limitations, it is preferably selected from materials that would not easily oscillate to absorb the energy of collision generated by water drops colliding with the surface of the semispherical projection. More specifically, if the semispherical projection may suitably be made of polyacetal or made of stainless steel and coated with polyacetal, water drops that are discharged from the spray and collide with the surface of the semispherical projection would not flow down along the surface but become crushed into smaller drops, which would be dispersed into the space of the cylindrical mist chamber to satisfactorily get in touch with and absorb carbonic acid gas.

If water is discharged from the spray with a pressure higher than the predetermined pressure of carbonic acid gas in the carbonic acid gas pressure container by more than 3 $Kg/cm^2$, it is broken into fine drops, which then collide with the surface of the semispherical projection at an appropriate speed and become crushed into smaller drops so that the latter may be dispersed into the space of the cylindrical mist chamber without flowing down along the surface of the semispherical projection to produce high quality carbonated water.

Preferably, a water level control sensor is arranged in the carbonic acid gas pressure container to detect the level of the carbonated water in the pressure container and produce a signal representing the level in order to control the water supply pump of the apparatus by referring to the upper limit water level, the lower limit water level and the critical water level for carbonated water. With such an arrangement, the apparatus improves its safety and hence can constantly supply delicious carbonated water.

According to a fourth aspect of the invention, there is provided an apparatus for manufacturing carbonated water by contact between carbonic acid gas and water introduced into a carbonic acid gas pressure container it comprises, characterized in that it additionally comprises a spray for introducing water into the carbonic acid gas pressure container and a metal network arranged close to the front end of the spray so that water drops discharged from the spray collide with the metal network and are atomized and dispersed to collide and become mixed with the water already in the pressure container.

Preferably, the metal network is a 50 to 250 mesh network.

With the above described arrangement of apparatus for manufacturing carbonated water, water drops discharged from the spray collide with the metal network to become divided into smaller water drops, which absorb carbonic acid gas and also collide with the water already in the pressure container to produce carbonated water containing therein a huge number of minute bubbles of carbonic acid gas that are well dispersed in the carbonated water. Such carbonated water of course tastes very agreeable.

The metal network is preferably a 50 to 250 mesh network. If a metal network coarser than 50 mesh is used, a large proportion of the water drops heading for it does not collide with it and consequently fine water drops cannot be satisfactorily obtained. If, on the other hand, a metal network finer than 250 mesh is used, it holds bubbles and consequently fine water drops cannot be satisfactorily obtained.

If water is discharged from the spray with a pressure higher than the predetermined pressure of carbonic acid gas in the carbonic acid gas pressure container by more than 3 $Kg/cm^2$, it is broken into fine drops, which then collide with the surface of the metal network at an appropriate speed and become crushed into smaller drops so that the latter may be dispersed to produce high quality carbonated water.

Preferably, a water level control sensor is arranged in the carbonic acid gas pressure container to detect the level of the carbonated water in the pressure container and produce a signal representing the level in order to control the water supply pump of the apparatus by referring to the upper limit water level, the lower limit water level and the critical water level for carbonated water. With such an arrangement, the apparatus improves its safety and hence can constantly supply delicious carbonated water.

According to a fourth aspect of the invention, there is provided an apparatus for manufacturing carbonated water by contact between carbonic acid gas and water introduced into a carbonic acid gas pressure container it comprises, characterized in that it additionally comprises a spray for introducing water into the carbonic acid gas pressure container and a cylindrical guide having an end rigidly secured to the front end of the spray and an open opposite end so that water drops discharged from the spray collide with the inner wall surface of the cylindrical guide and are atomized and dispersed to collide and become mixed with the water already in the pressure container.

Preferably, the spray is a hollow corn type spray.

Preferably, water is discharged from the spray with a pressure higher than the predetermined pressure of carbonic acid gas in the carbonic acid gas pressure container by more than 3 $Kg/cm^2$.

Preferably, a water level control sensor is arranged in the carbonic acid gas pressure container to detect the level of the carbonated water in the pressure container and produce a signal representing the level in order to control the water supply pump of the apparatus by referring to the upper limit water level, the lower limit water level and the critical water level for carbonated water. With such an arrangement, the apparatus improves its safety and hence can constantly supply delicious carbonated water.

With the above described arrangement of apparatus for manufacturing carbonated water, water drops discharged from the spray collide with the inner wall surface of the cylindrical guide the metal network to become divided into smaller water drops, which absorb carbonic acid gas and also dispersed out of the cylindrical guide to collide with the water already in the pressure container to produce carbonated water containing therein a huge number of minute bubbles of carbonic acid gas that are well dispersed in the carbonated water. Such carbonated water of course tastes very agreeable.

The spray may be either of a full corn type or a hollow corn type. If a hollow corp type spray is used, all the water discharged out of the spray collides with the inner wall surface of the cylindrical guide to make fine drops, which are dispersed and collide with the water already in the pressure container to produce carbonated water containing therein a huge number of minute bubbles of carbonic acid gas that are well dispersed in the carbonated water. Such carbonated water of course tastes very agreeable.

If water is discharged from the spray with a pressure higher than the predetermined pressure of carbonic acid gas in the carbonic acid gas pressure container by more than 3 $Kg/cm^2$, it is broken into fine drops, which then collide with the surface of the metal network at an appropriate speed and become crushed into smaller drops so that the latter may be dispersed to produce high quality carbonated water.

Preferably, a water level control sensor is arranged in the carbonic acid gas pressure container to detect the level of the carbonated water in the pressure container and produce a signal representing the level in order to control the water supply pump of the apparatus by referring to the upper limit water level, the lower limit water level and the critical water level for carbonated water. With such an arrangement, the apparatus improves its safety and hence can constantly supply delicious carbonated water.

DETAILED DESCRIPTION OF THE PREFERRED EMBODIMENTS

The present invention will now be described by referring to the accompanying drawings that illustrate preferred embodiments of the invention, although the present invention is not limited to them by any means.

Figure 1:
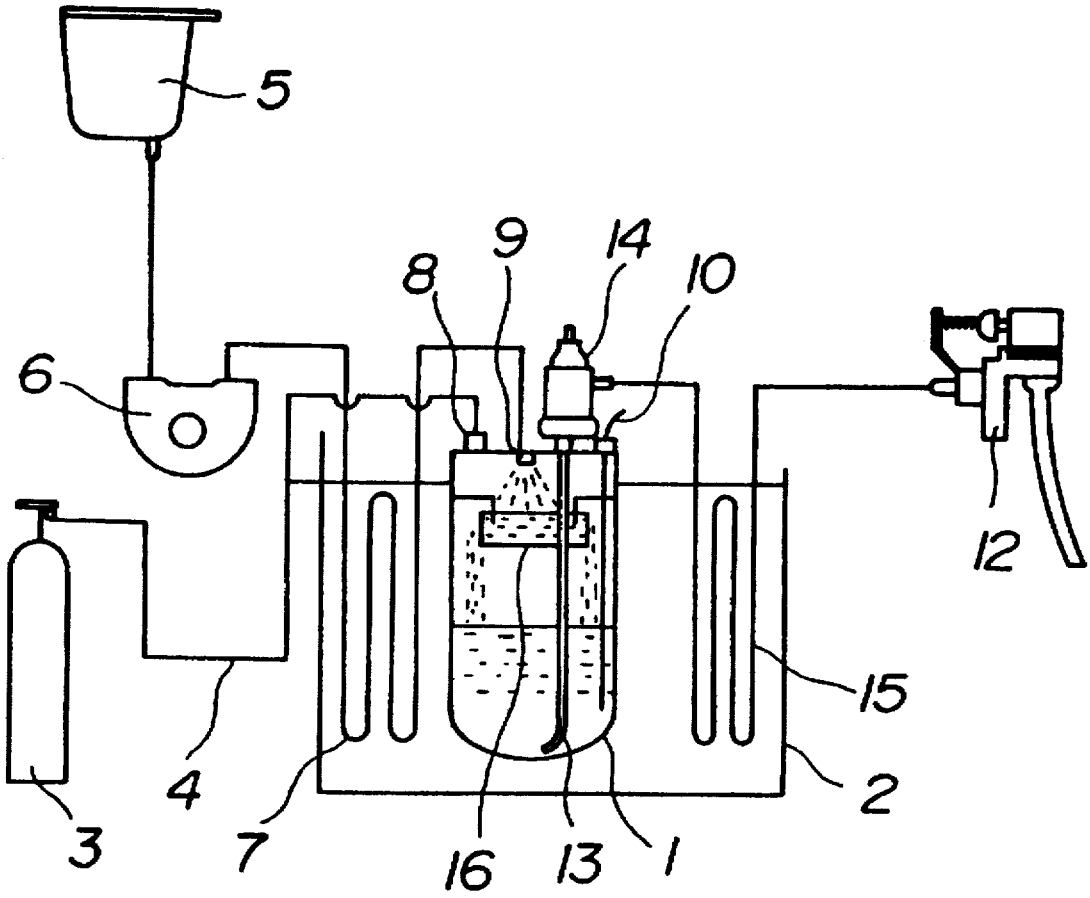
FIG. 1 is a schematic illustration of an embodiment of apparatus for manufacturing carbonated water according to the invention.
Figure 2:
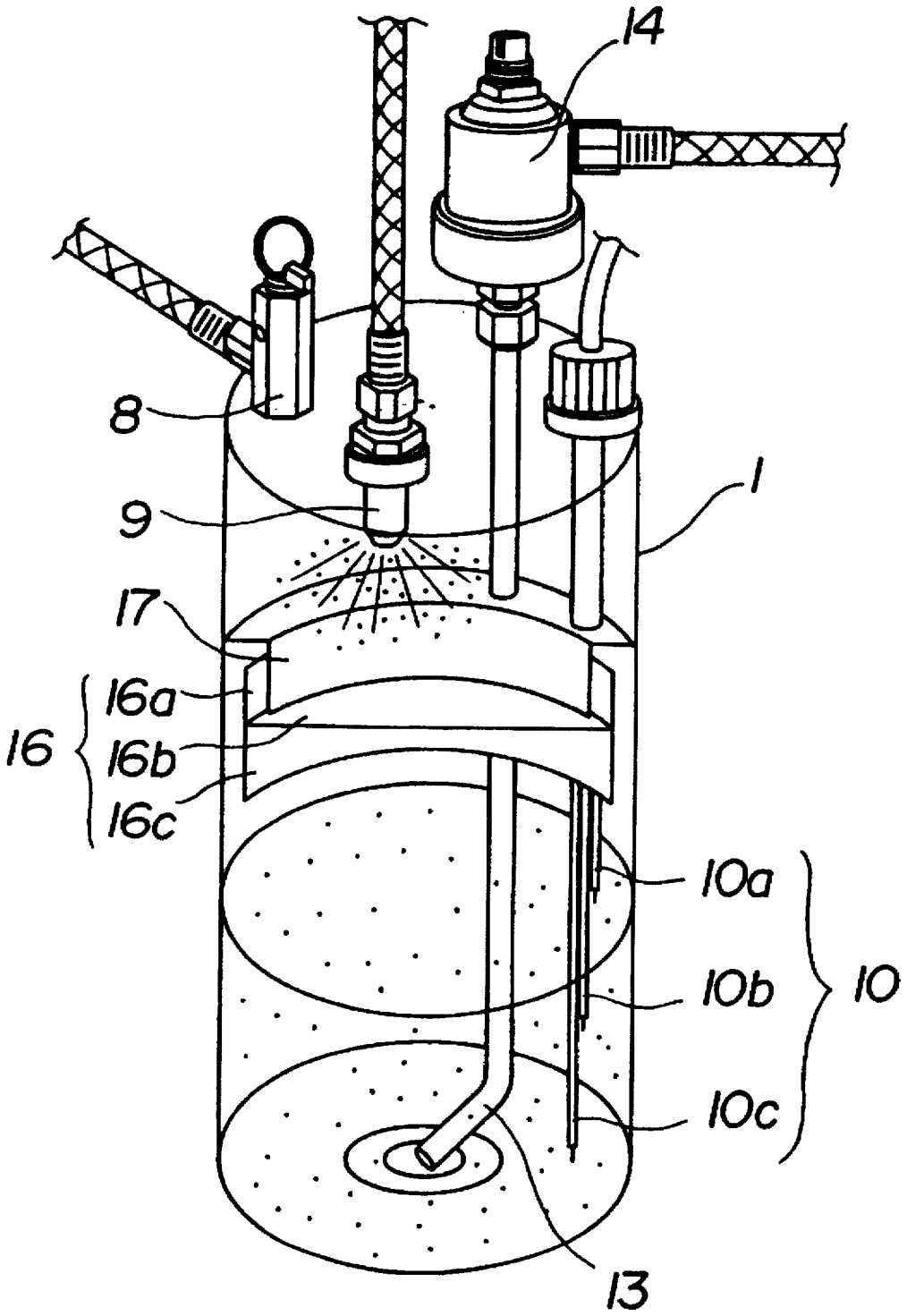
FIG. 2 is an enlarged schematic perspective view of a mixing vessel that can be used for the embodiment of FIG. 1.

FIG. 1 is a schematic illustration of an embodiment of apparatus for manufacturing carbonated water according to the invention. FIG. 2 is an enlarged schematic perspective view of a mixing vessel that can be used for the embodiment of FIG. 1.

Referring to FIGS. 1 and 2, a carbonic acid gas pressure container 1 is dipped in a cooling water tank 2 and kept in a cooled state. Pressurized carbonic acid gas is fed from a carbonic acid gas bomb 3 into the carbonic acid gas pressure container 1 by way of a carbonic acid gas conduit 4 and an inlet port 8 arranged at an upper portion of the carbonic acid gas pressure container 1, while pressurized water is fed from a cistern 5 storing tap water into the carbonic acid gas pressure container 1 by means of a water supply pump 6, a cooling coil 7 and a spray 9 disposed also at an upper portion of the carbonic acid gas pressure container 1.

A mixing vessel 16 is arranged below the carbonic acid gas inlet port 8 and the spray 9 with a gap disposed between the peripheral wall thereof and the inner wall of the carbonic acid gas pressure container 1. Water discharged from the spray is broken into fine drops, which absorb carbonic acid gas and eventually collide with the water already in the pressure container to produce carbonated water containing therein a huge number of minute bubbles of carbonic acid gas that are well dispersed in the carbonated water. Such carbonated water of course tastes very agreeable.

If water is discharged from the spray 9 with a pressure higher than the predetermined pressure of carbonic acid gas in the carbonic acid gas pressure container by more than 3 $Kg/cm^2$, it is broken into fine drops mainly having a diameter between 0.01 and 0.5 mm, which fine drops then collide with the water already in the mixing vessel 16 at a speed at least not lower than 5 cm/sec to produce high quality carbonated water.

The produced carbonated water passes under a partition panel 17 having an end rigidly secured to the inner peripheral wall of the carbonic acid gas pressure container 1 and the opposite end extending close to the bottom 16*b* of the mixing vessel 16. It then passes through the gap between the partition panel 17 and the peripheral wall 16*a* of the mixing vessel 16 and overflows the peripheral wall 16*a* to flow down through the gap between the inner wall of the carbonic acid gas pressure container 1 and the peripheral wall 16*a* to the bottom of the carbonic acid gas pressure container 1. Since the produced carbonated water fully gets in touch with and absorb carbonic acid gas as it flows down to the bottom of the carbonic acid gas pressure container, consequently high quality carbonated water can be obtained.

The height of the peripheral wall 16*a* of the mixing vessel 16, the distance between the bottom 16*b* of the mixing vessel 16 and the lower end of the partition panel 17, the gap between the partition panel 17 and the peripheral wall 16*a* and the gap between the peripheral wall 16*a* and the inner wall of the carbonic acid gas pressure container 1 are so selected as to maintain the water in the mixing vessel to a predetermined level and, at the same time, increase the contact space between water and carbonic acid gas. In other words, they are preferably so selected that water drops discharged from the spray collide with the water already in the pressure container to produce carbonated water containing therein a huge number of minute bubbles of carbonic acid gas that are well dispersed and absorbed into the carbonated water and the produced carbonated water flows down to the bottom of the carbonic acid gas pressure container, satisfactorily contacting with carbonic acid gas to slowly absorb the latter.

Preferably, the mixing vessel 16 is provided with a guide panel 16*c* extending downward from the bottom 16*b* as an extension of the peripheral wall 16*a* in order for the produced carbonated water to be satisfactorily held in contact with carbonic acid gas. The height of the guide panel 16*c* may be such that overflowing carbonated water is made to flow down along it.

A water level control sensor 10 is arranged in the carbonic acid gas pressure container 1 and, when the carbonated water in the pressure container 1 falls under a predetermined level, it actuates the pump 6 to supply water from the cistern 5. Water coming from the cistern 5 is cooled by the cooling coil 7 that is immersed in the cooling water tank 2 before it is fed into the carbonic acid gas pressure container 1.

More specifically, the water level control sensor 10 may comprise a sensing member 10*a* arranged at a given upper limit water level, a sensing member 10*b* arranged at a given lower limit water level and a sensing member 10*c* arranged at a given critical water level so that it stops the operation of the water supply pump 6 when the level of carbonated water goes above the upper limit, actuates the water supply pump 6 again when the level of carbonated water goes below the lower limit and produces a buzzing sound as a warning when the level of carbonated water falls below the critical water level by means of respective signals. Gas can hardly be separated from the carbonated water produced in this manner even when the latter is taken into the mouth and warmed to the body temperature and, therefore, it emits gas when it passes through the throat, which is thus satisfactorily stimulated with agreeable pungency.

The carbonated water produced in the carbonic acid gas pressure container 1 is taken out through a siphon tube 13 when a carbonated water supply valve 12 is opened for vending and cooled again in a cooling coil 15 under the control of a flow rate control unit 14 before it is fed to the outside.

Figure 3:
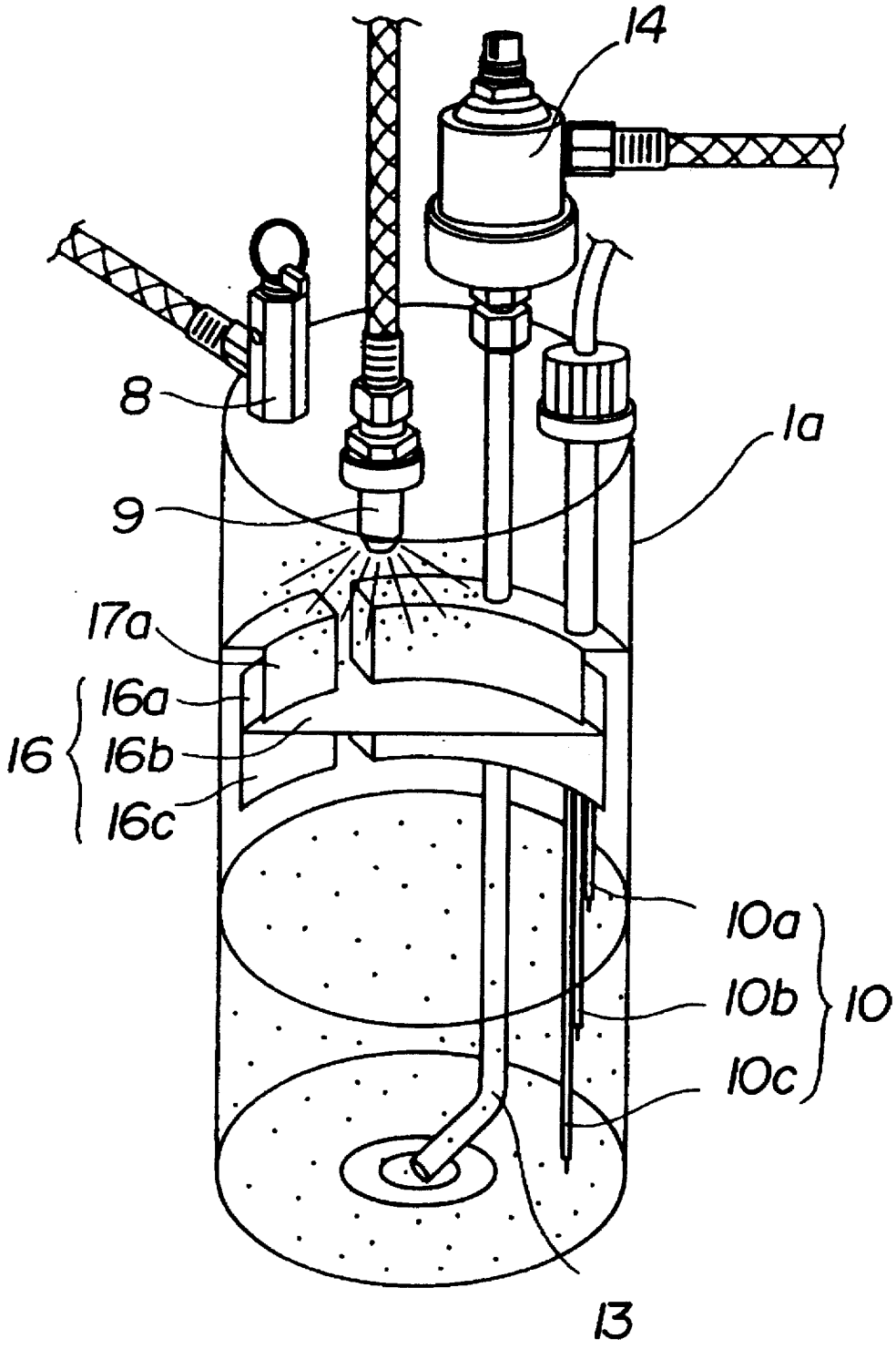
FIG. 3 is an enlarged schematic perspective view of another mixing vessel that can be used for the embodiment of FIG. 1.
Figure 4:
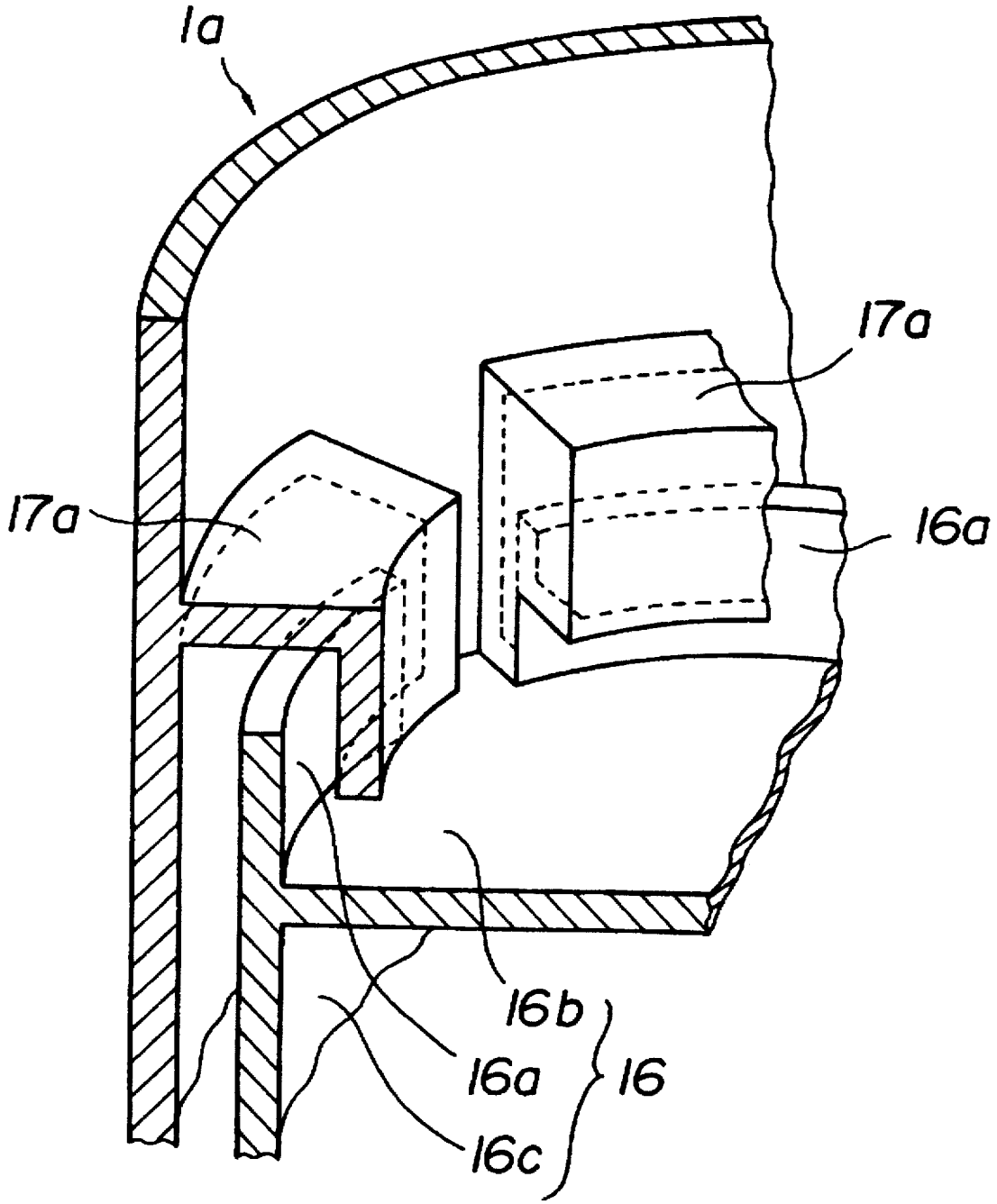
FIG. 4 is an enlarged schematic perspective partial view of the mixing vessel of FIG. 3.

FIG. 3 is an enlarged schematic perspective view of another mixing vessel that can be used for the above embodiment and FIG. 4 is an enlarged schematic perspective partial view of the mixing vessel of FIG. 3.

The carbonic acid gas pressure container 1*a* of FIG. 3 differs from the carbonic acid gas pressure container 1 of FIG. 2 in that, while the partition panel 17 of the carbonic acid gas pressure container 1 of FIG. 2 extends substantially along the entire inner wall of the pressure container 1, the partition panel 17*a* of the carbonic acid gas pressure container 1*a* of FIG. 3 is partly cut away. With such an arrangement, the partition panel 17*a* and the mixing vessel 16 can be integrally formed and, therefore, the gap between the peripheral wall 16*a* of the mixing vessel 16 and the partition panel 17*a* and the distance between the bottom 16*b* of the mixing vessel 16 and the lower end of the partition panel 17*a* can be determined precisely.

Figure 5:
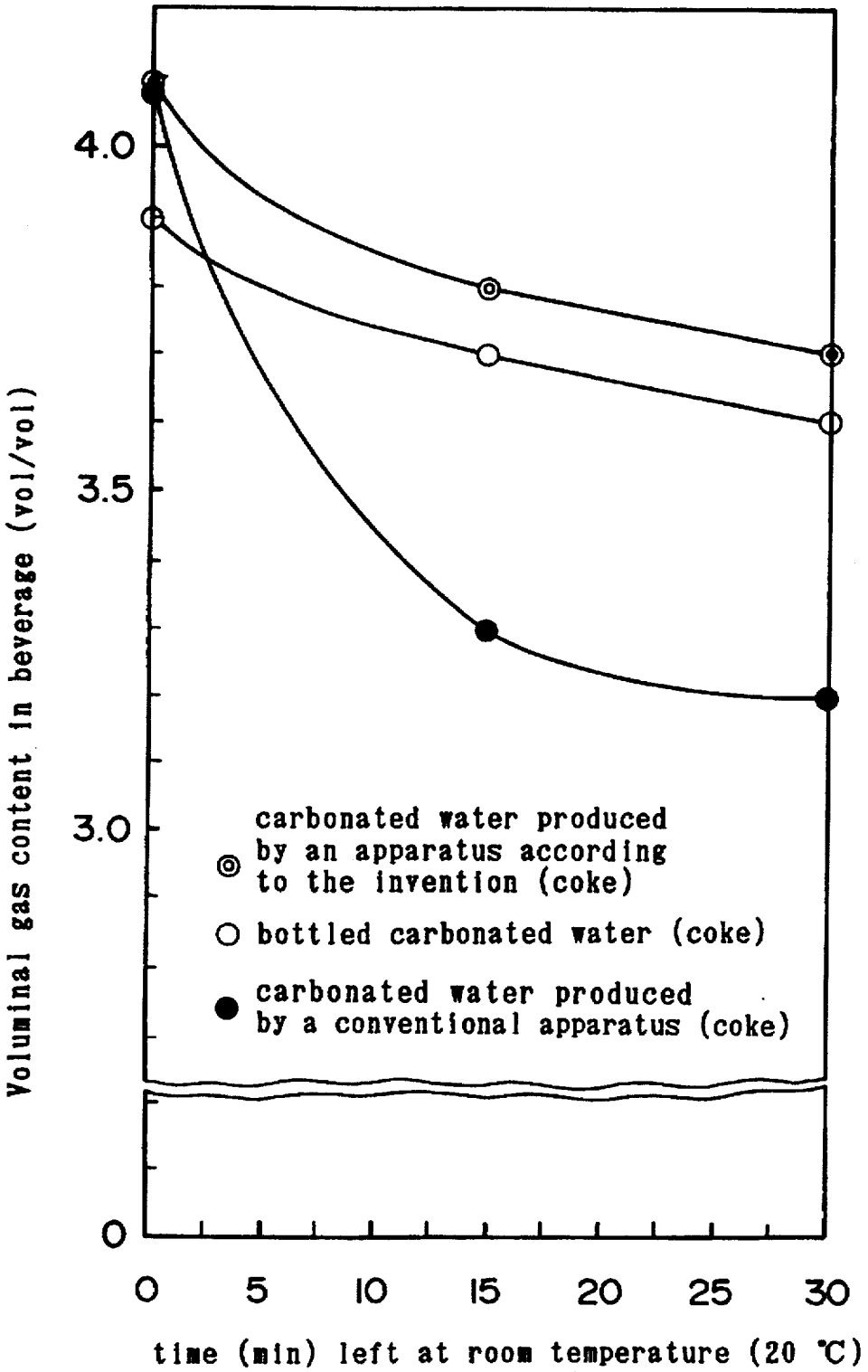
FIG. 5 is a graph showing the relationship between the time carbonated water is left at room temperature (20° C.) and the residual carbonic acid gas content for the embodiment of FIG. 1.

FIG. 5 is a graph showing the relationship between the time carbonated water (2° C.) (◎) is left at room temperature (20° C.) and the residual carbonic acid gas content (carbonic acid gas volume/carbonated water volume) obtained in an experiment for the embodiment of FIG. 1. For the purpose of comparison, commercially available bottled carbonated water (○) and carbonated water manufactured by an existing carbonated water manufacturing apparatus (●) were also tested. As evidenced by FIG. 5, carbonated water prepared by the above embodiment of carbonated water manufacturing apparatus according to the invention shows a high carbonic acid gas content level and retains the gas content for a prolonged period of time just as commercially available bottled carbonated water, whereas carbonated water prepared by a known manufacturing apparatus shows a high initial carbonic acid gas content level but loses the gas content quickly.

Figure 6:
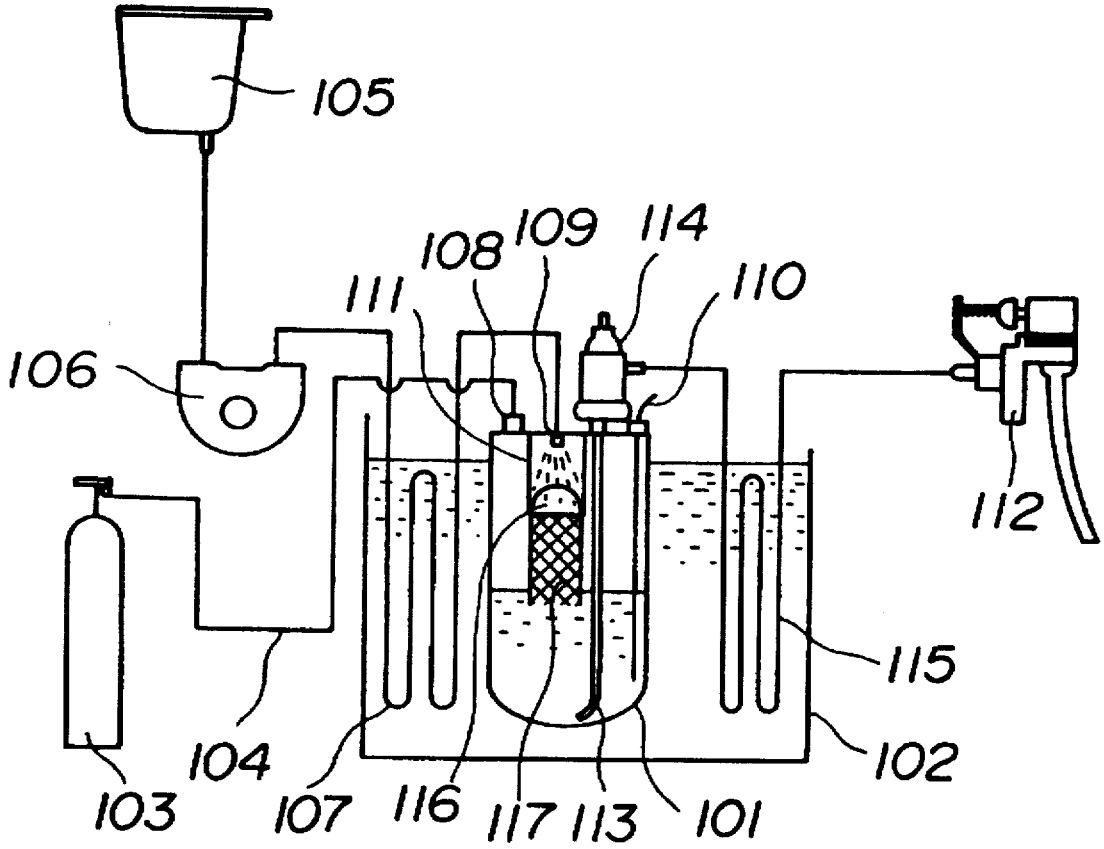
FIG. 6 is a schematic illustration of another embodiment of apparatus for manufacturing carbonated water according to the invention.
Figure 7:
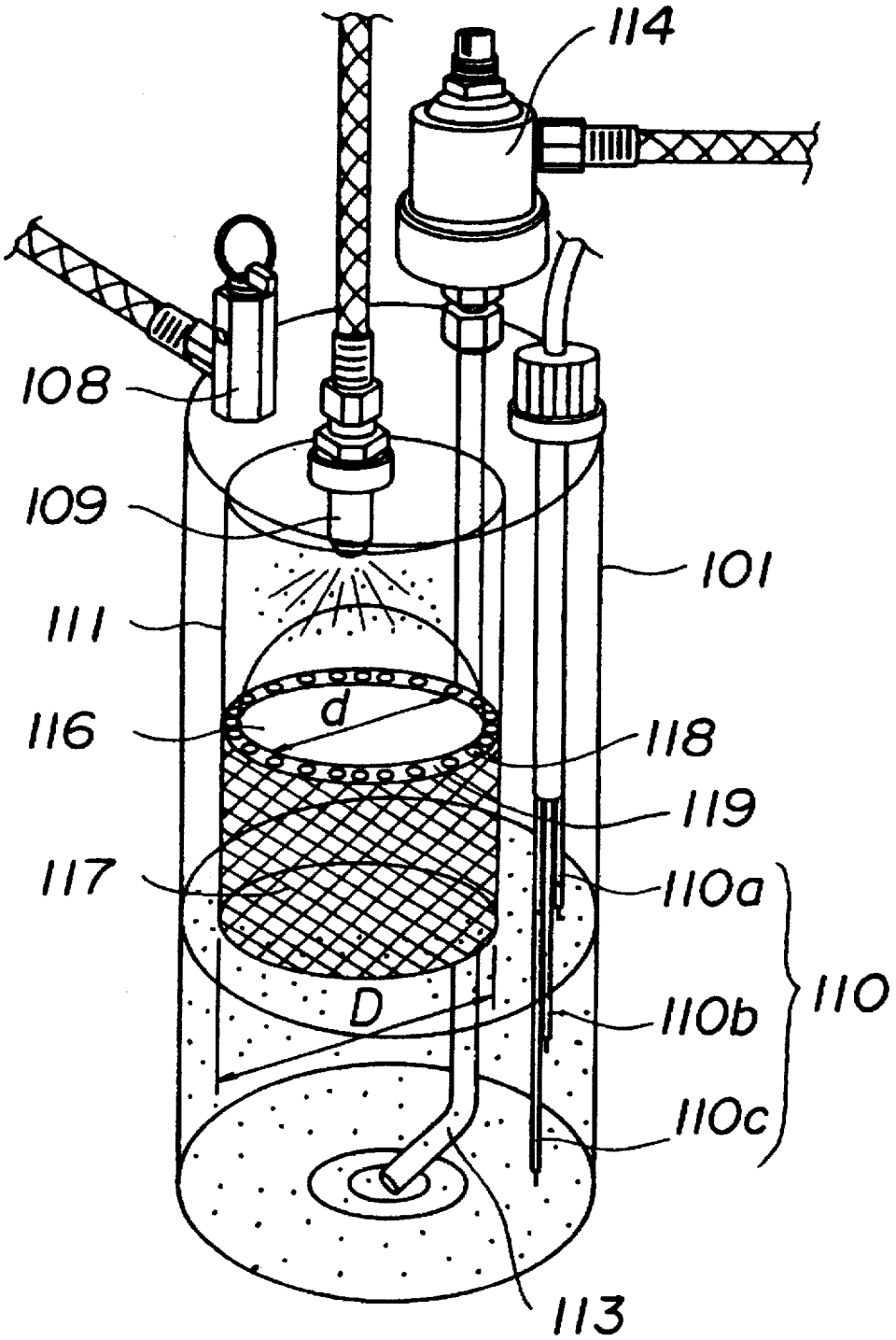
FIG. 7 is an enlarged schematic perspective view of a carbonic acid gas pressure container that can be used for the embodiment of FIG. 6.

FIG. 6 is a schematic illustration of another embodiment of apparatus for manufacturing carbonated water according to the invention. FIG. 7 is an enlarged schematic perspective view of a carbonic acid gas pressure container that can be used for the embodiment of FIG. 6.

Referring to FIGS. 6 and 7, a carbonic acid gas pressure container 101 is dipped in a cooling water tank 102 and kept in a cooled state. Pressurized carbonic acid gas is fed from a carbonic acid gas bomb 103 into the carbonic acid gas pressure container 101 by way of a carbonic acid gas conduit 104 and an inlet port 108 arranged at an upper portion of the carbonic acid gas pressure container 101, while pressurized water is fed from a cistern 105 storing tap water into a cylindrical mist chamber 111 arranged in the carbonic acid gas pressure container 101 by means of a water supply pump 106, a cooling coil 107 and a spray 109 disposed also at an upper portion of the carbonic acid gas pressure container 101. The cylindrical mist chamber 111 has its top and peripheral walls hermetically sealed and is provided at the bottom with a semispherical projection 116 of polyacetal.

The semispherical projection 116 is connected to the bottom of the cylindrical mist chamber 111 by means of a coupling member 119 and the diameter d of its circular bottom is smaller than the inner diameter D of the cylindrical mist chamber 111. The coupling member connecting the semispherical projection 116 and the cylindrical mist chamber 111 is provided with a large number of small holes 118. A cylindrical metal network 117 having open top and bottom is connected to the lower end of the coupling member 119.

Water drops discharged from the spray 109 collide with the surface of the semispherical projection 116 of polyacetal and are broken into smaller drops, which are then dispersed in the cylindrical mist chamber 111 to sufficiently get in touch with carbonic acid gas before they flow down through the small holes 118 and the cylindrical metal network 117 to wet the latter and further absorb carbonic acid gas over a large surface area thereof. The lower end of the cylindrical metal network 117 is held in contact with the carbonated water in the carbonic acid gas pressure container 101 so that carbonated water sufficiently containing carbonic acid gas flows down toward the bottom of the carbonic acid gas pressure container 101 to ensure its high quality.

If water is discharged from the spray with a pressure higher than the predetermined pressure of carbonic acid gas in the carbonic acid gas pressure container by more than 3 $Kg/cm^2$, it collide with the surface of the semispherical projection 116 in the form of fine drops at an appropriate speed and broken down into smaller drops, which are then dispersed in the cylindrical mist chamber 111 to sufficiently get in touch with and absorb carbonic acid gas so that high quality carbonated water can be obtained.

A water level control sensor 110 is arranged in the carbonic acid gas pressure container 101 and, when the carbonated water in the pressure container 101 falls under a predetermined level, it actuates the pump 106 to supply water from the cistern 105. Water coming from the cistern 105 is cooled by the cooling coil 107 that is immersed in the cooling water tank 102 before it is fed into the carbonic acid gas pressure container 101.

More specifically, the water level control sensor 110 may comprise a sensing member 110*a* arranged at a given upper limit water level, a sensing member 110*b* arranged at a given lower limit water level and a sensing member 110*c* arranged at a given critical water level so that it stops the operation of the water supply pump 106 when the level of carbonated water goes above the upper limit, actuates the water supply pump 106 again when the level of carbonated water goes below the lower limit and produces a buzzing sound as a warning when the level of carbonated water falls below the critical water level by means of respective signals.

Gas can hardly be separated from the carbonated water produced in this manner even when the latter is taken into the mouth and warmed to the body temperature and, therefore, it emits gas when it passes through the throat, which is thus satisfactorily stimulated with agreeable pungency.

The carbonated water produced in the carbonic acid gas pressure container 101 is taken out through a siphon tube 113 when a carbonated water supply valve 112 is opened for vending and cooled again in a cooling coil 115 under the control of a flow rate control unit 114 before it is fed to the outside.

Figure 8:
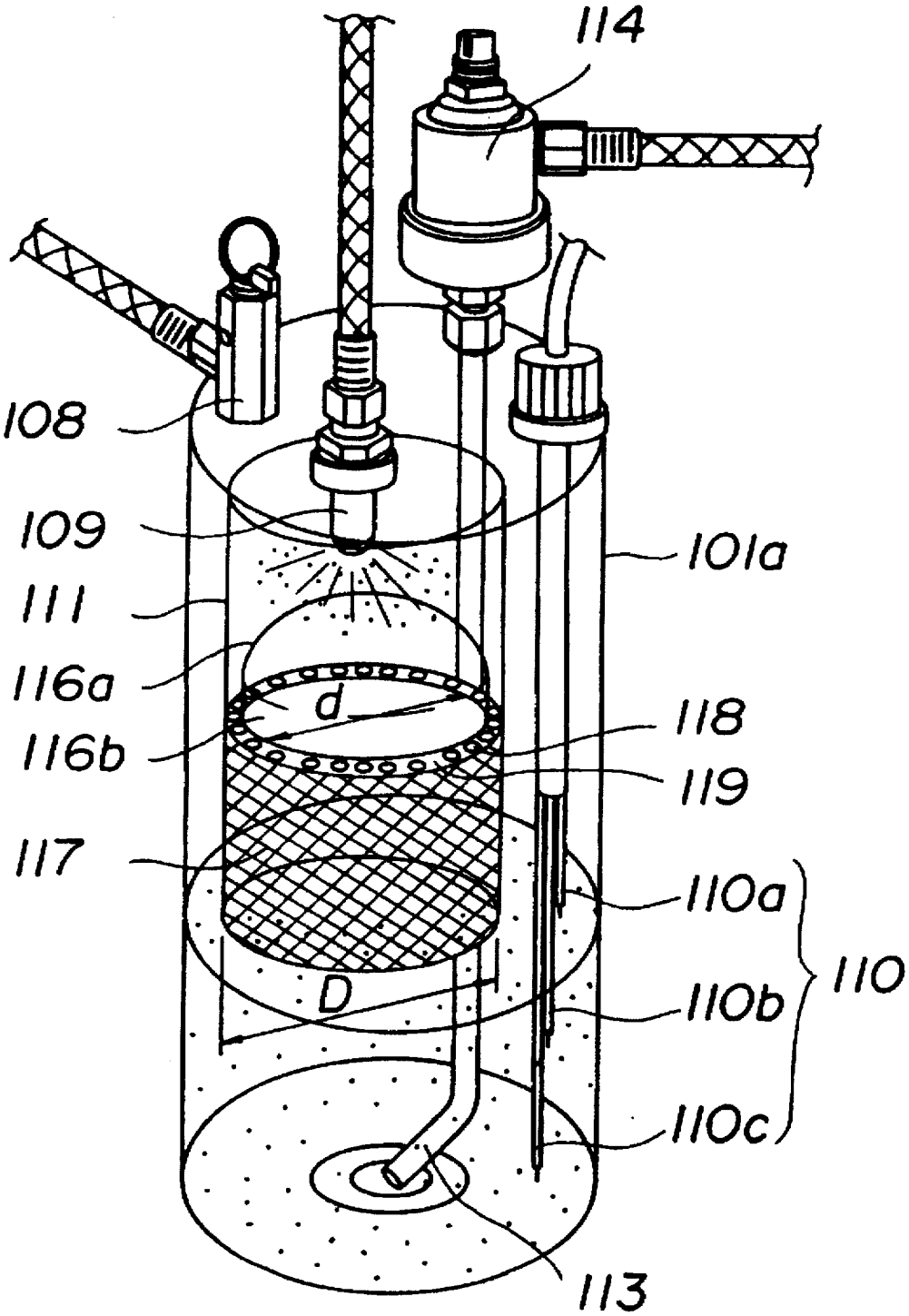
FIG. 8 is an enlarged schematic perspective view of another carbonic acid gas pressure container that can be used for the embodiment of FIG. 6.

FIG. 8 is an enlarged schematic perspective view of another carbonic acid gas pressure container 101*a* that can be used for the embodiment of carbonated water manufacturing apparatus of FIG. 6. This pressure container 101*a* differs from that of FIGS. 6 and 7 only in that the semispherical projection 116*a* of polyacetal has a cylindrical section 116*b*. The components in FIG. 8 similar to those of their counterparts of FIGS. 6 and 7 are denoted by the same reference symbols.

Figure 9:
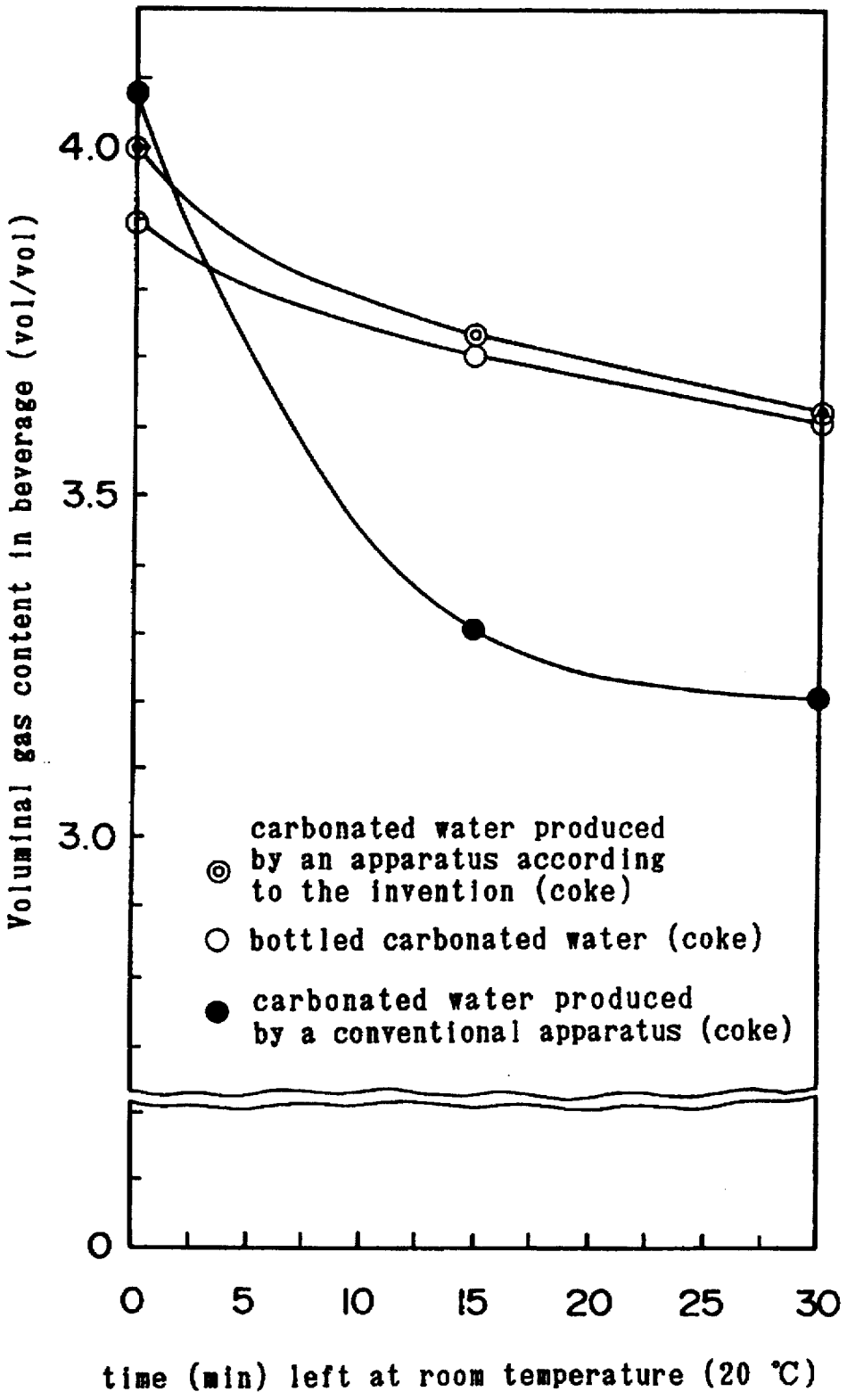
FIG. 9 is a graph showing the relationship between the time carbonated water is left at room temperature (20° C.) and the residual carbonic acid gas content for the embodiment of FIG. 6.

FIG. 9 is a graph showing the relationship between the time carbonated water (2° C.) (◎) is left at room temperature (20° C.) and the residual carbonic acid gas content (carbonic acid gas volume/carbonated water volume) obtained in an experiment for the embodiment of FIG. 6. For the purpose of comparison, commercially available bottled carbonated water (○) and carbonated water manufactured by an existing carbonated water manufacturing apparatus (●) were also tested. As evidenced by FIG. 9, carbonated water prepared by the above embodiment of carbonated water manufacturing apparatus according to the invention shows a high carbonic acid gas content level and retains the gas content for a prolonged period of time just as commercially available bottled carbonated water, whereas carbonated water prepared by a known manufacturing apparatus shows a high initial carbonic acid gas content level but loses the gas content quickly.

Figure 10:
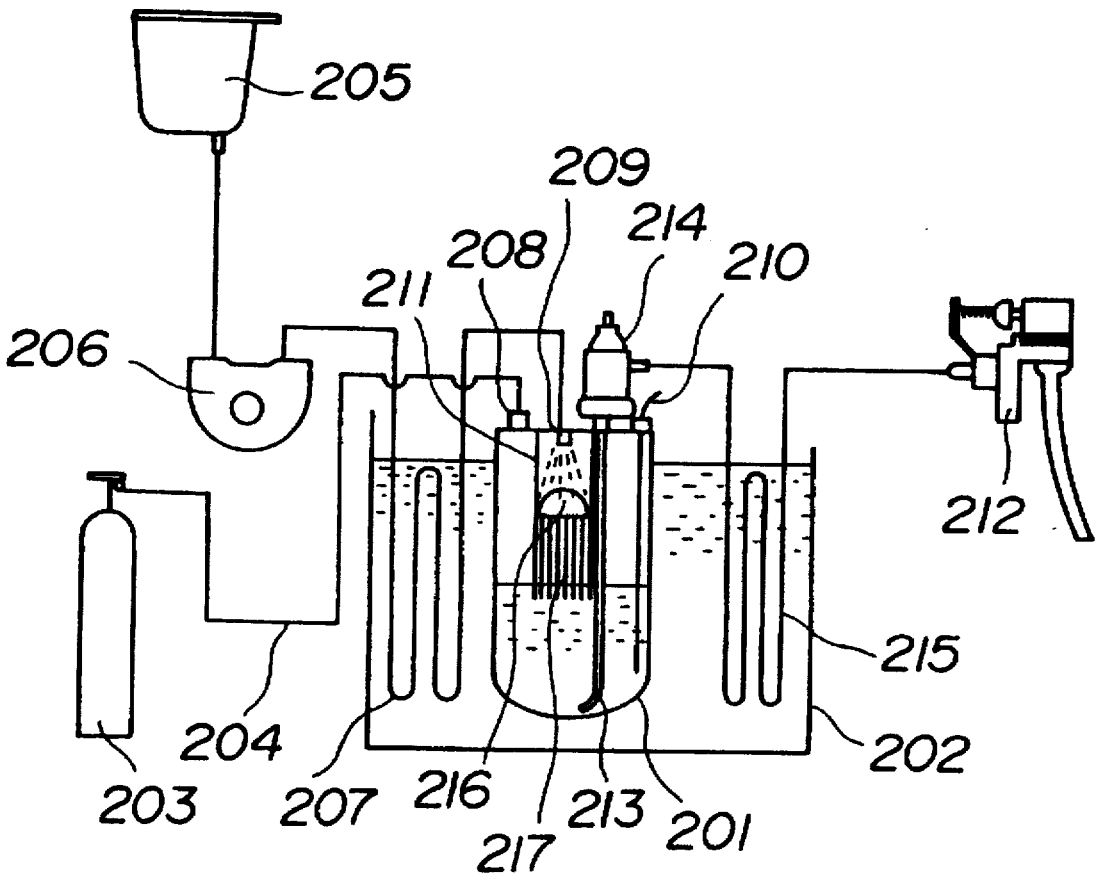
FIG. 10 is a schematic illustration of still another embodiment of apparatus for manufacturing carbonated water according to the invention.
Figure 11:
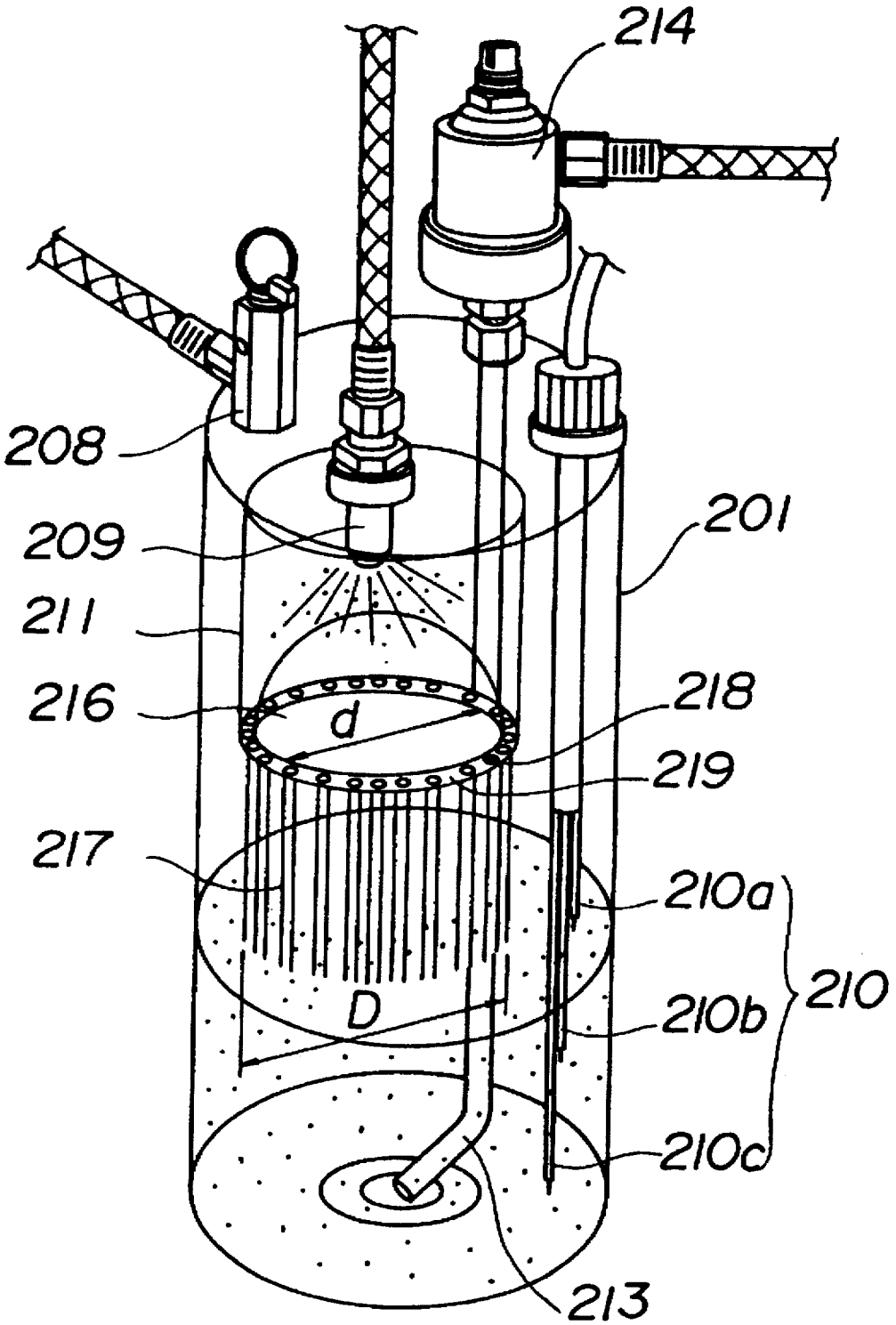
FIG. 11 is an enlarged schematic perspective view of a carbonic acid gas pressure container that can be used for the embodiment of FIG. 10.

FIG. 10 is a schematic illustration of another embodiment of apparatus for manufacturing carbonated water according to the invention. FIG. 11 is an enlarged schematic perspective view of a carbonic acid gas pressure container that can be used for the embodiment of FIG. 10.

Referring to FIGS. 10 and 11, a carbonic acid gas pressure container 201 is dipped in a cooling water tank 202 and kept in a cooled state. Pressurized carbonic acid gas is fed from a carbonic acid gas bomb 203 into the carbonic acid gas pressure container 201 by way of a carbonic acid gas conduit 204 and an inlet port 208 arranged at an upper portion of the carbonic acid gas pressure container 201, while pressurized water is fed from a cistern 205 storing tap water into a cylindrical mist chamber 211 arranged in the carbonic acid gas pressure container 201 by means of a water supply pump 206, a cooling coil 207 and a spray 209 disposed also at an upper portion of the carbonic acid gas pressure container 201. The cylindrical mist chamber 211 has its top and peripheral walls hermetically sealed and is provided at the bottom with a semispherical projection 216 of polyacetal.

The semispherical projection 216 is connected to the bottom of the cylindrical mist chamber 211 by means of a coupling member 219 and the diameter d of its circular bottom is smaller than the inner diameter D of the cylindrical mist chamber 211. The coupling member connecting the semispherical projection 216 and the cylindrical mist chamber 211 is provided with a large number of small holes 218. Also a large number of metal wires 217 are connected to the lower end of the coupling member 219 at positions corresponding to those of the small holes 218.

Water drops discharged from the spray 209 collide with the surface of the semispherical projection 216 of polyacetal and are broken into smaller drops, which are then dispersed in the cylindrical mist chamber 211 to sufficiently get in touch with carbonic acid gas before they flow down through the small holes 218 and the metal wires 217 to wet the latter and further absorb carbonic acid gas over a large surface area thereof. The lower ends of the metal wires 217 are held in contact with the carbonated water in the carbonic acid gas pressure container 201 so that carbonated water sufficiently containing carbonic acid gas flows down toward the bottom of the carbonic acid gas pressure container 201 to ensure its high quality.

If water is discharged from the spray with a pressure higher than the predetermined pressure of carbonic acid gas in the carbonic acid gas pressure container by more than 3 $Kg/cm^2$, it collide with the surface of the semispherical projection 216 in the form of fine drops at an appropriate speed and broken down into smaller drops, which are then dispersed in the cylindrical mist chamber 211 to sufficiently get in touch with and absorb carbonic acid gas so that high quality carbonated water can be obtained.

A water level control sensor 210 is arranged in the carbonic acid gas pressure container 201 and, when the carbonated water in the pressure container 201 falls under a predetermined level, it actuates the pump 206 to supply water from the cistern 205. Water coming from the cistern 205 is cooled by the cooling coil 207 that is immersed in the cooling water tank 202 before it is fed into the carbonic acid gas pressure container 201.

More specifically, the water level control sensor 210 may comprise a sensing member 210*a* arranged at a given upper limit water level, a sensing member 210*b* arranged at a given lower limit water level and a sensing member 210*c* arranged at a given critical water level so that it stops the operation of the water supply pump 206 when the level of carbonated water goes above the upper limit, actuates the water supply pump 206 again when the level of carbonated water goes below the lower limit and produces a buzzing sound as a warning when the level of carbonated water falls below the critical water level by means of respective signals.

Gas can hardly be separated from the carbonated water produced in this manner even when the latter is taken into the mouth and warmed to the body temperature and, therefore, it emits gas when it passes through the throat, which is thus satisfactorily stimulated with agreeable pungency.

The carbonated water produced in the carbonic acid gas pressure container 201 is taken out through a siphon tube 213 when a carbonated water supply valve 212 is opened for vending and cooled again in a cooling coil 215 under the control of a flow rate control unit 214 before it is fed to the outside.

Figure 12:
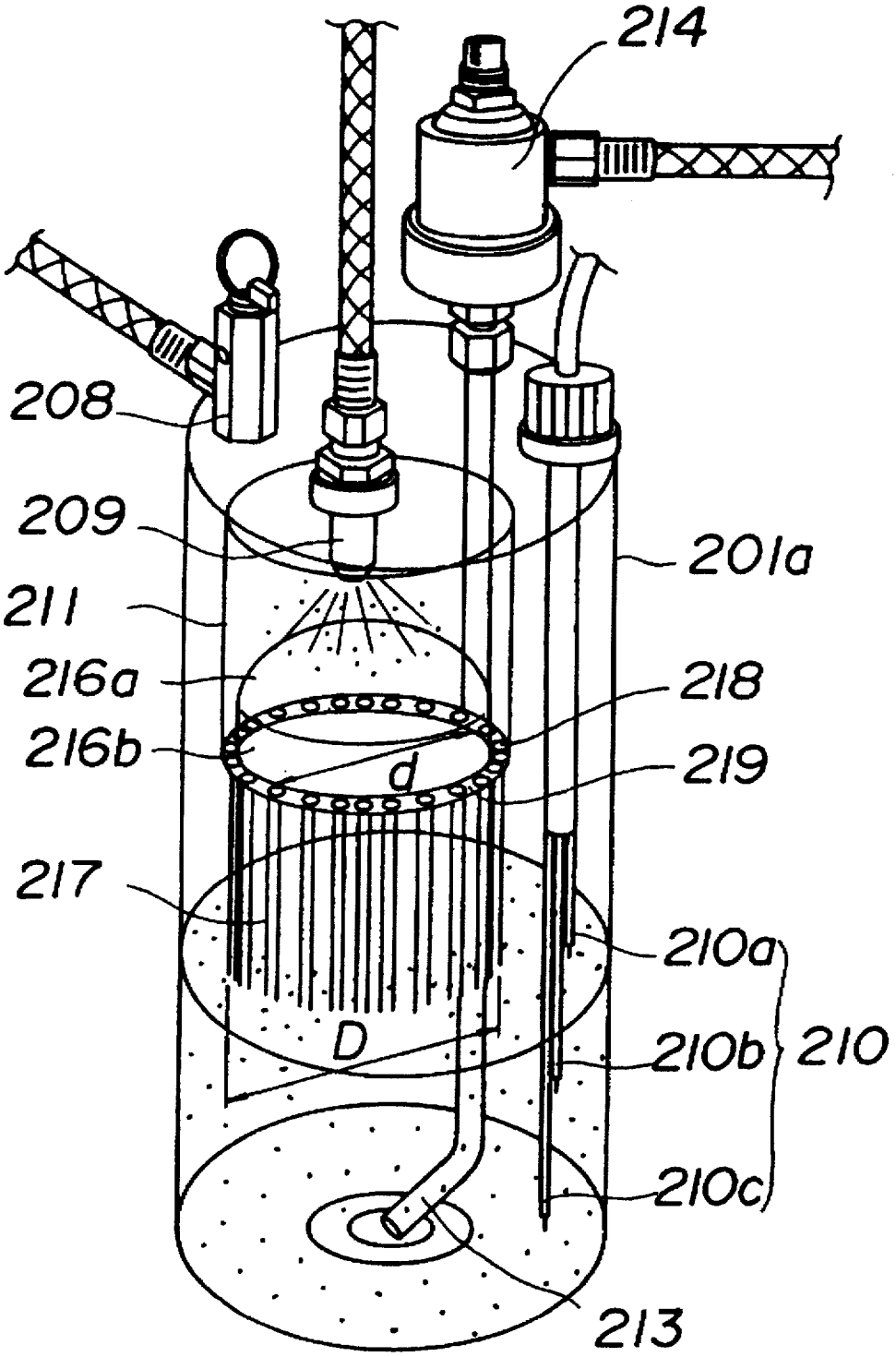
FIG. 12 is an enlarged schematic perspective view of another carbonic acid gas pressure container that can be used for the embodiment of FIG. 10.

FIG. 12 is an enlarged schematic perspective view of another carbonic acid gas pressure container 201*a* that can be used for the embodiment of carbonated water manufacturing apparatus of FIG. 10. This pressure container 201*a* differs from that of FIGS. 10 and 11 only in that the semispherical projection 216*a* of polyacetal has a cylindrical section 216*b*. The components in FIG. 12 similar to those of their counterparts of FIGS. 10 and 11 are denoted by the same reference symbols.

Figure 13:
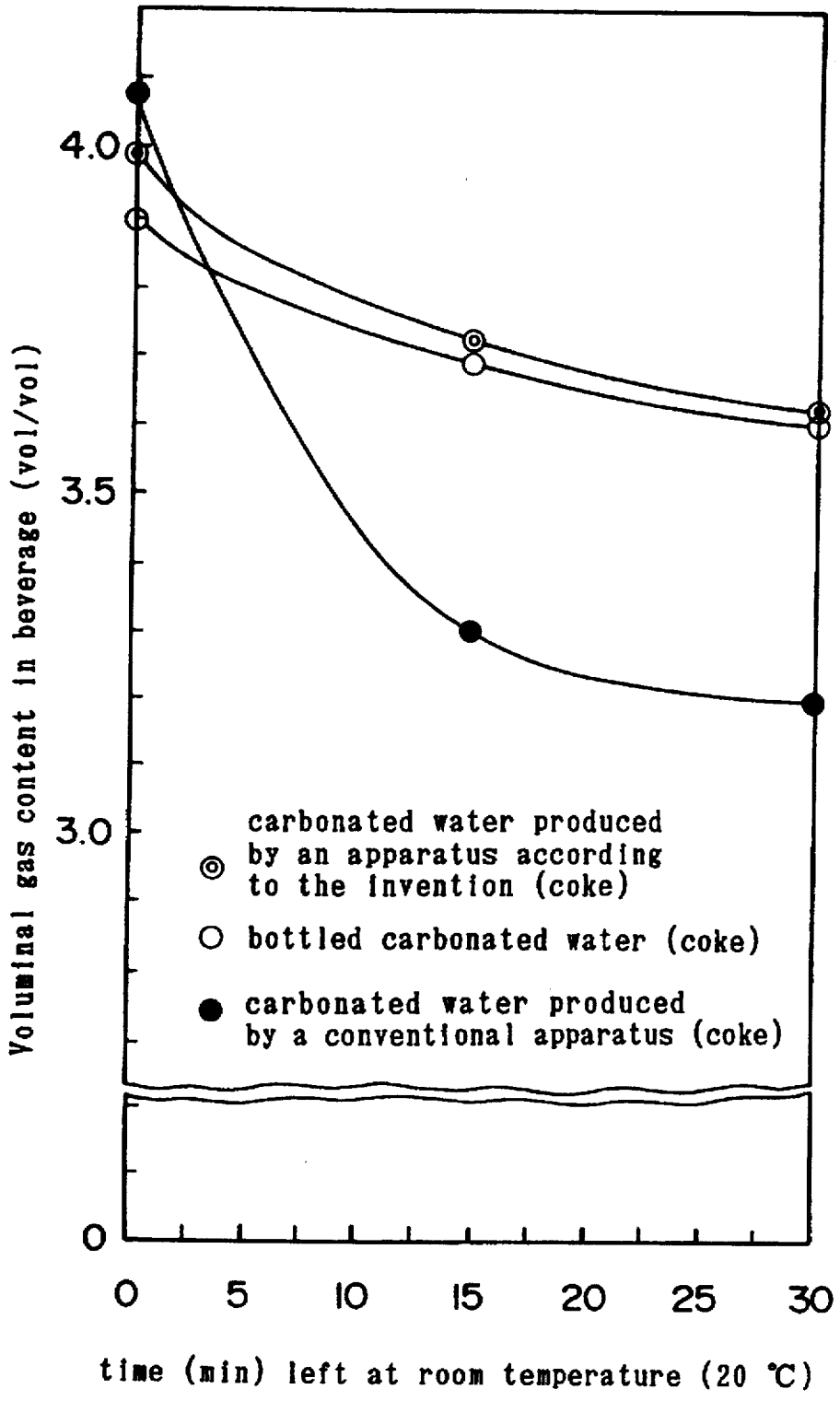
FIG. 13 is a graph showing the relationship between the time carbonated water is left at room temperature (20° C.) and the residual carbonic acid gas content for the embodiment of FIG. 10.

FIG. 13 is a graph showing the relationship between the time carbonated water (2° C.) (◎) is left at room temperature (20° C.) and the residual carbonic acid gas content (carbonic acid gas volume/carbonated water volume) obtained in an experiment for the embodiment of FIG. 10. For the purpose of comparison, commercially available bottled carbonated water (○) and carbonated water manufactured by an existing carbonated water manufacturing apparatus (●) were also tested. As evidenced by FIG. 13, carbonated water prepared by the above embodiment of carbonated water manufacturing apparatus according to the invention shows a high carbonic acid gas content level and retains the gas content for a prolonged period of time just as commercially available bottled carbonated water, whereas carbonated water prepared by a known manufacturing apparatus shows a high initial carbonic acid gas content level but loses the gas content quickly.

Figure 14:
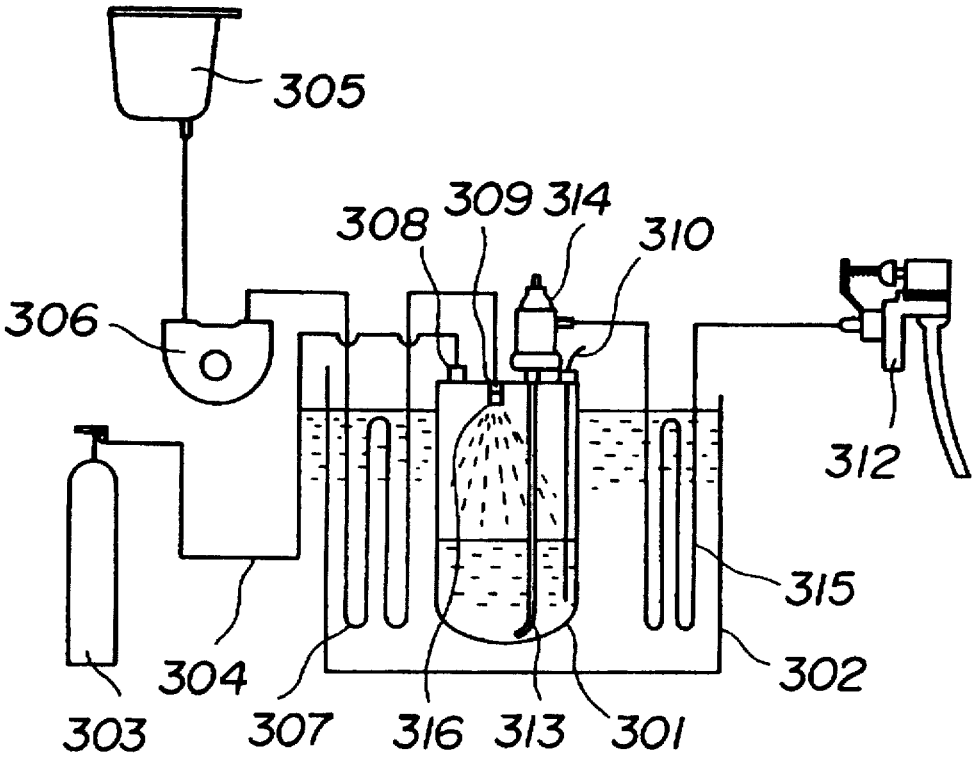
FIG. 14 is a schematic illustration of still another embodiment of apparatus for manufacturing carbonated water according to the invention.
Figure 15:
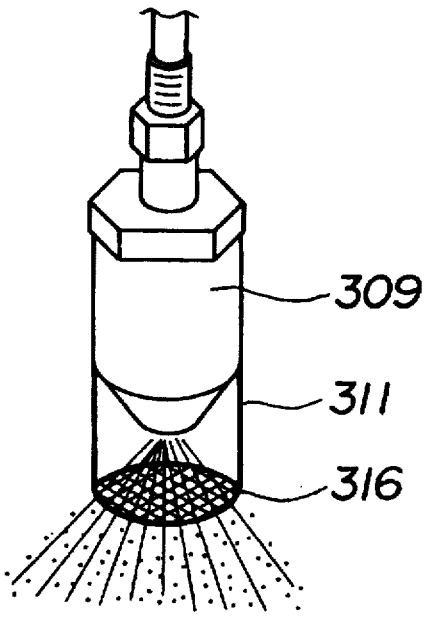
FIG. 15 is an enlarged schematic perspective view of a nozzle that can be used for the embodiment of FIG. 14.
Figure 16:
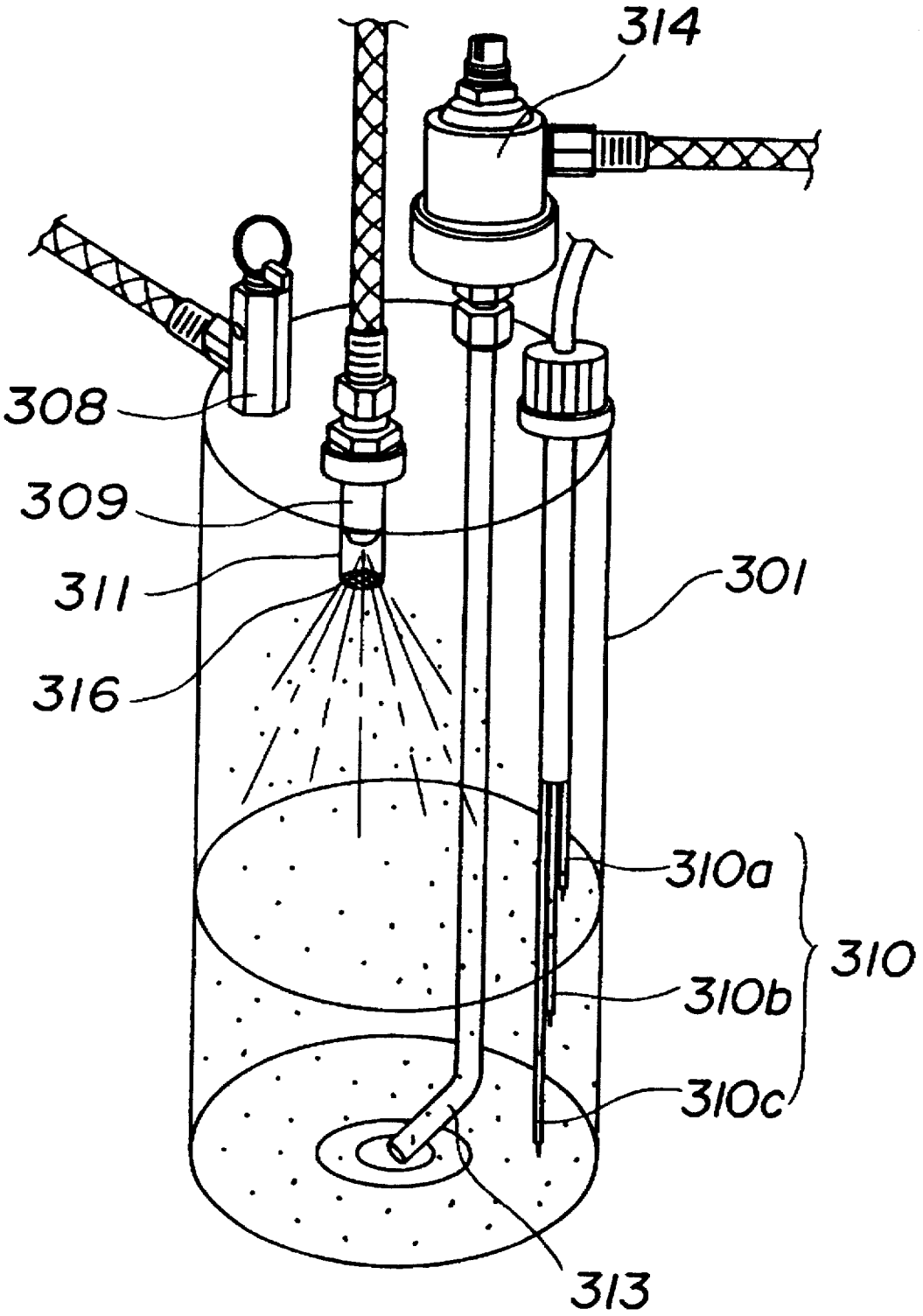
FIG. 16 is an enlarged schematic perspective view of a carbonic acid gas pressure container that can be used for the embodiment of FIG. 14.

FIG. 14 is a schematic illustration of still another embodiment of apparatus for manufacturing carbonated water according to the invention. FIG. 15 is an enlarged schematic perspective view of a nozzle that can be used for the embodiment of FIG. 14. FIG. 16 is an enlarged schematic perspective view of a carbonic acid gas pressure container that can be used for the embodiment of FIG. 14.

Referring to FIGS. 14 through 16, a carbonic acid gas pressure container.301 is dipped in a cooling water tank 302 and kept in a cooled state. Pressurized carbonic acid gas is fed from a carbonic acid gas bomb 303 into the carbonic acid gas pressure container 301 by way of a carbonic acid gas conduit 304 and an inlet port 308 arranged at an upper portion of the carbonic acid gas pressure container 301, while pressurized water is fed from a cistern 305 storing tap water by means of a water supply pump 306, a cooling coil 307 and a spray 309 disposed also at an upper portion of the carbonic acid gas pressure container 301.

A metal network 316 is arranged closed to the front end of the spray 309 and rigidly secured to the latter by means of a holder member 311 so that water drops discharged from the spray 309 collide with the metal network 316 and are broken into smaller drops to sufficiently get in touch with carbonic acid gas and also collide with the water already in the pressure container 301 to produce carbonated water containing therein a huge number of minute bubbles of carbonic acid gas that are well dispersed in the carbonated water. Such carbonated water of course tastes very agreeable. The holder member 311 for rigidly securing the metal network 316 to the spray 309 may be of any shape such as rod-shaped or cylindrical so long as it can rigidly secure the metal network 316.

If water is discharged from the spray with a pressure higher than the predetermined pressure of carbonic acid gas in the carbonic acid gas pressure container 301 by more than 3 $Kg/cm^2$, it collide with the surface of the metal network 316 in the form of fine drops mainly having a diameter between 0.01 and 0.5 mm at the speed of at least 5 cm/sec and broken down into smaller drops that further absorb carbonic acid gas and also collide with the water already in the pressure container 301 to produce high quality carbonated water.

The spray may be either of a full corn type or a hollow corn type.

A water level control sensor 310 is arranged in the carbonic acid gas pressure container 301 and, when the carbonated water in the pressure container 301 falls under a predetermined level, it actuates the pump 306 to supply water from the cistern 305. Water coming from the cistern 305 is cooled by the cooling coil 307 that is immersed in the cooling water tank 302 before it is fed into the carbonic acid gas pressure container 301.

More specifically, the water level control sensor 310 may comprise a sensing member 310*a* arranged at a given upper limit water level, a sensing member 310*b* arranged at a given lower limit water level and a sensing member 310*c* arranged at a given critical water level so that it stops the operation of the water supply pump 306 when the level of carbonated water goes above the upper limit, actuates the water supply pump 306 again when the level of carbonated water goes below the lower limit and produces a buzzing sound as a warning when the level of carbonated water falls below the critical water level by means of respective signals.

Gas can hardly be separated from the carbonated water produced in this manner even when the latter is taken into the mouth and warmed to the body temperature and, therefore, it emits gas when it passes through the throat, which is thus satisfactorily stimulated with agreeable pungency.

The carbonated water produced in the carbonic acid gas pressure container 301 is taken out through a siphon tube 313 when a carbonated water supply valve 312 is opened for vending and cooled again in a cooling coil 315 under the control of a flow rate control unit 314 before it is fed to the outside.

Figure 17:
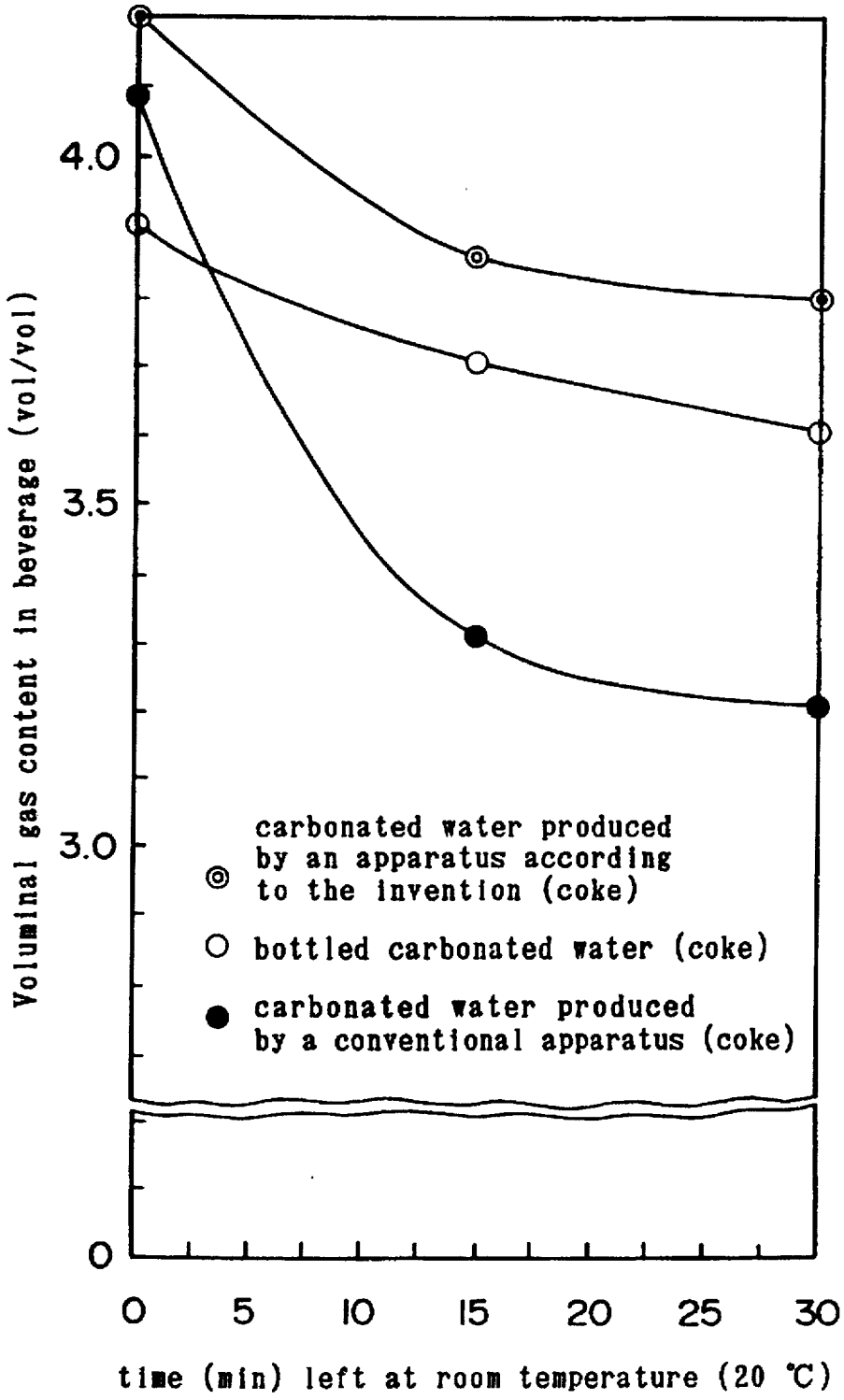
FIG. 17 is a graph showing the relationship between the time carbonated water is left at room temperature (20° C.) and the residual carbonic acid gas content for the embodiment of FIG. 14.

FIG. 17 is a graph showing the relationship between the time carbonated water (2° C.) (◎) is left at room temperature (20° C.) and the residual carbonic acid gas content (carbonic acid gas volume/carbonated water volume) obtained in an experiment for the embodiment of FIG. 14. For the purpose of comparison, commercially available bottled carbonated water (○) and carbonated water manufactured by an existing carbonated water manufacturing apparatus (●) were also tested. As evidenced by FIG. 17, carbonated water prepared by the above embodiment of carbonated water manufacturing apparatus according to the invention shows a high carbonic acid gas content level and retains the gas content for a prolonged period of time just as commercially available bottled carbonated water, whereas carbonated water prepared by a known manufacturing apparatus shows a high initial carbonic acid gas content level but loses the gas content quickly.

Figure 18:
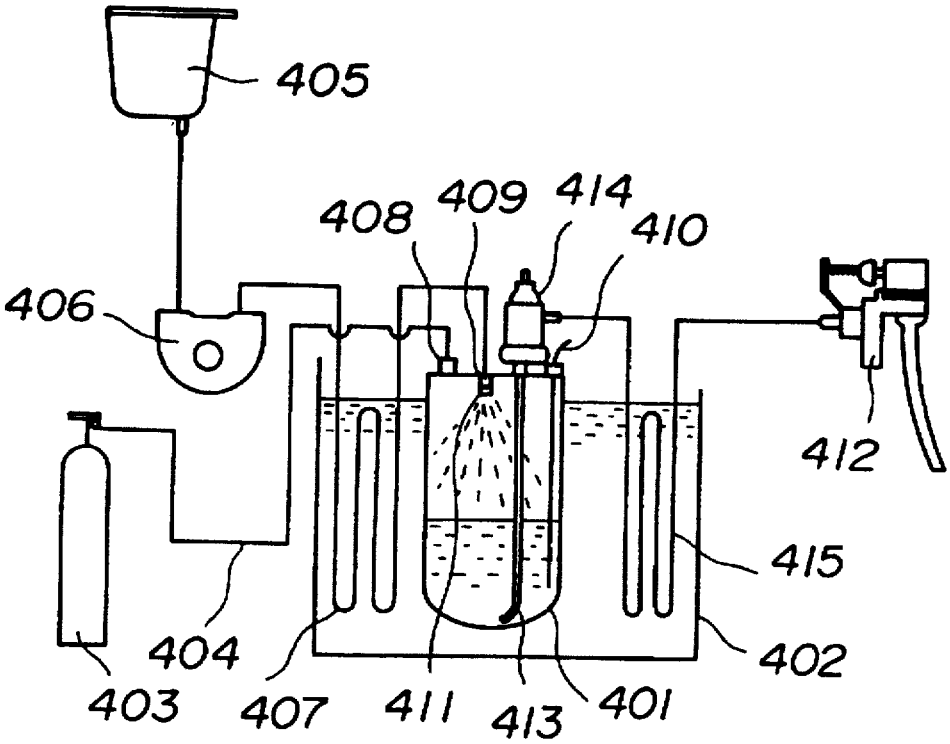
FIG. 18 is a schematic illustration of still another embodiment of apparatus for manufacturing carbonated water according to the invention.
Figure 19:
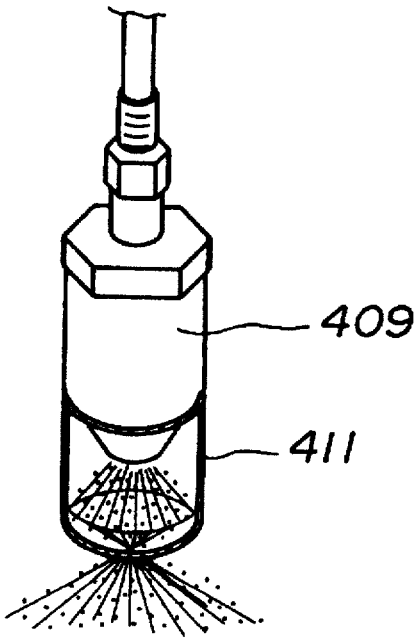
FIG. 19 is an enlarged schematic perspective view of a nozzle that can be used for the embodiment of FIG. 18.
Figure 20:
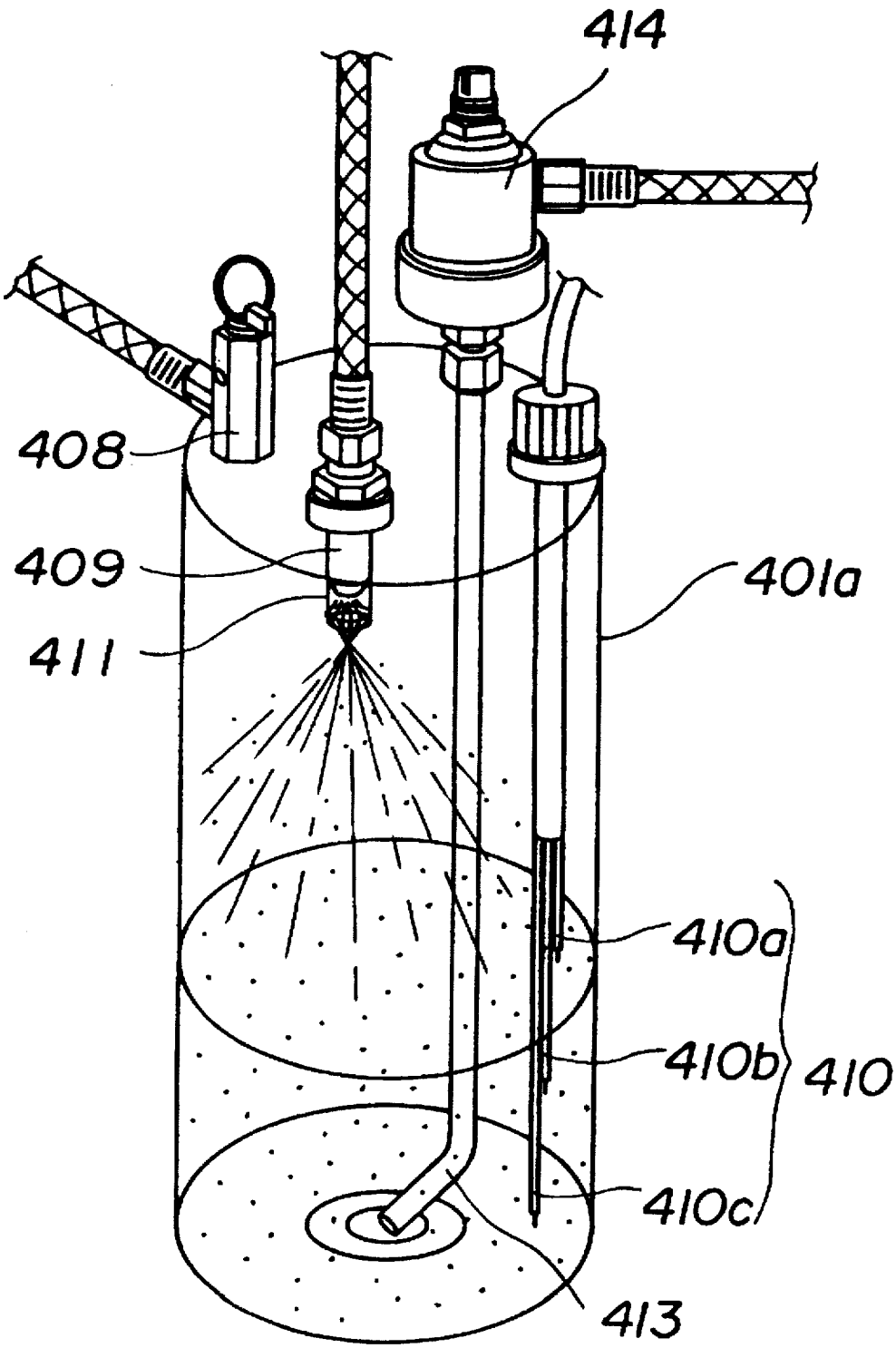
FIG. 20 is an enlarged schematic perspective view of a carbonic acid gas pressure container that can be used for the embodiment of FIG. 18.

FIG. 18 is a schematic illustration of still another embodiment of apparatus for manufacturing carbonated water according to the invention. FIG. 19 is an enlarged schematic perspective view of a nozzle that can be used for the embodiment of FIG. 18, where a cylindrical guide arranged there is shown in cross section. FIG. 20 is an enlarged schematic perspective view of a carbonic acid gas pressure container that can be used for the embodiment of FIG. 18.

Referring to FIGS. 18 through 20, a carbonic acid gas pressure container 401 is dipped in a cooling water tank 402 and kept in a cooled state. Pressurized carbonic acid gas is fed from a carbonic acid gas bomb 403 into the carbonic acid gas pressure container 401 by way of a carbonic acid gas conduit 404 and an inlet port 408 arranged at an upper portion of the carbonic acid gas pressure container 401, while pressurized water is fed from a cistern 405 storing tap water by means of a water supply pump 406, a cooling coil 407 and a hollow corn type spray 309 disposed also at an upper portion of the carbonic acid gas pressure container 401.

A cylindrical guide 411 extends from the spray 409 with an end rigidly secured to the front end of the spray 409 and the opposite end is left open so that water drops discharged from the spray collide with the inner wall surface of the cylindrical guide 411 and are atomized and dispersed to absorb carbonic acid gas and, at the same time, collide and become mixed with the water already in the pressure container 401 to produce carbonated water containing therein a huge number of minute bubbles of carbonic acid gas that are well dispersed in the carbonated water. Such carbonated water of course tastes very agreeable.

The cylindrical guide 411 is not subject to specific limitations in terms of size and material so long as sprayed water appropriately collides with the inner surface thereof and is broken into fine drops. Materials that can be used for the cylindrical guide 411 include metals such as stainless steel, plastic materials such as polycarbonate and polyacetal, ceramic materials and mixtures of any of them. The inner wall surface of the cylindrical guide 411 may be either flat and smooth or appropriately undulated.

If water is discharged from the spray with a pressure higher than the predetermined pressure of carbonic acid gas in the carbonic acid gas pressure container 401 by more than 3 $Kg/cm^2$, it collide with the inner wall surface of the cylindrical guide 411 in the form of fine drops mainly having a diameter between 0.01 and 0.5 mm at the speed of at least 5 cm/sec and broken down into smaller drops that further absorb carbonic acid gas as they move out of the cylindrical guide 411 and also collide with the water already in the pressure container 401 to produce high quality carbonated water.

A water level control sensor 410 is arranged in the carbonic acid gas pressure container 401 and, when the carbonated water in the pressure container 401 falls under a predetermined level, it actuates the pump 406 to supply water from the cistern 405. Water coming from the cistern 305 is cooled by the cooling coil 407 that is immersed in the cooling water tank 402 before it is fed into the carbonic acid gas pressure container 401.

More specifically, the water level control sensor 410 may comprise a sensing member 410*a* arranged at a given upper limit water level, a sensing member 410*b* arranged at a given lower limit water level and a sensing member 410*c* arranged at a given critical water level so that it stops the operation of the water supply pump 406 when the level of carbonated water goes above the upper limit, actuates the water supply pump 406 again when the level of carbonated water goes below the lower limit and produces a buzzing sound as a warning when the level of carbonated water falls below the critical water level by means of respective signals.

Gas can hardly be separated from the carbonated water produced in this manner even when the latter is taken into the mouth and warmed to the body temperature and, therefore, it emits gas when it passes through the throat, which is thus satisfactorily stimulated with agreeable pungency.

The carbonated water produced in the carbonic acid gas pressure container 401 is taken out through a siphon tube 413 when a carbonated water supply valve 412 is opened for vending and cooled again in a cooling coil 415 under the control of a flow rate control unit 414 before it is fed to the outside.

Figure 21:
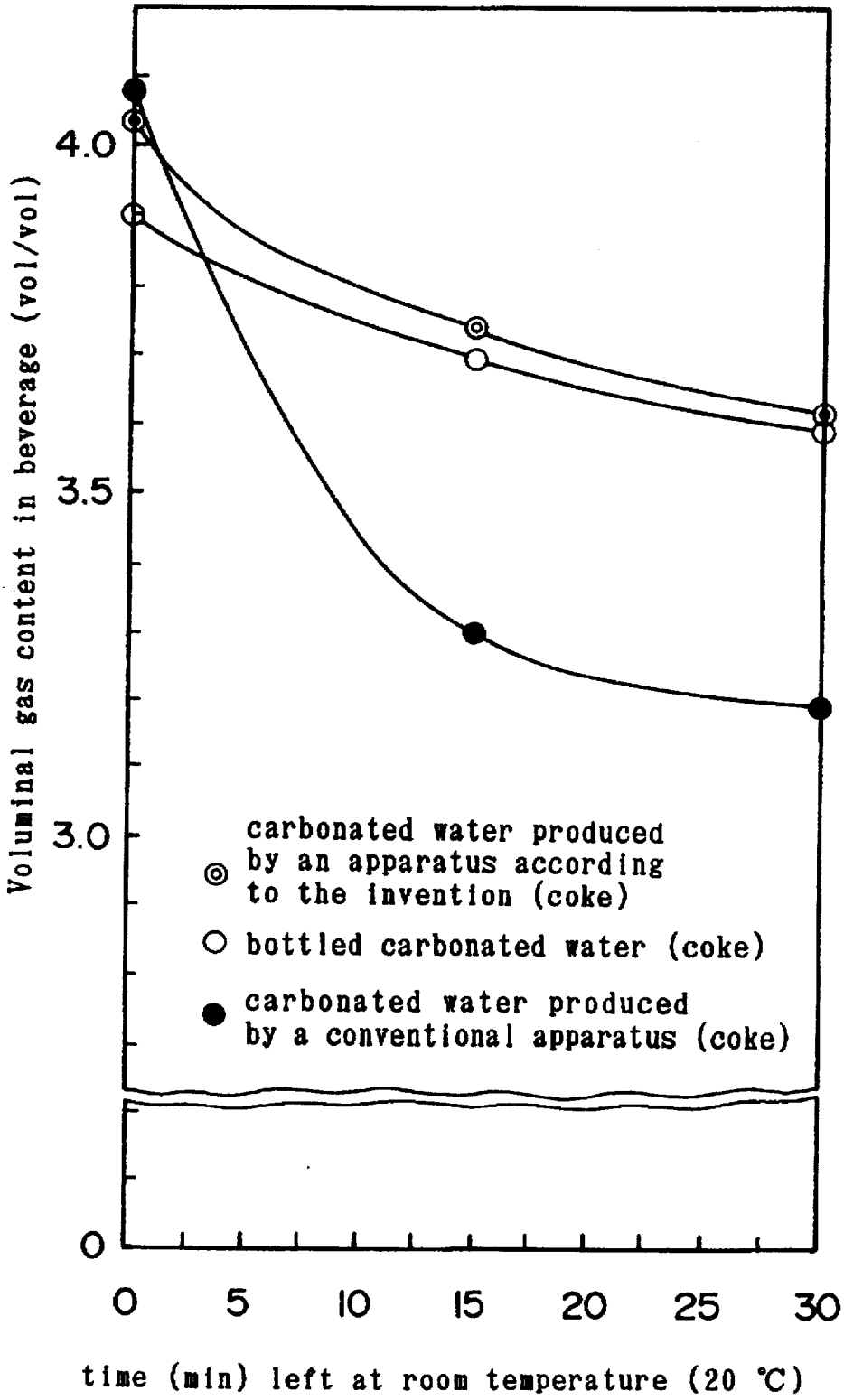
FIG. 21 is a graph showing the relationship between the time carbonated water is left at room temperature (20° C.) and the residual carbonic acid gas content for the embodiment of FIG. 18.

FIG. 21 is a graph showing the relationship between the time carbonated water (2° C.) (◎) is left at room temperature (20° C.) and the residual carbonic acid gas content (carbonic acid gas volume/carbonated water volume) obtained in an experiment for the embodiment of FIG. 18. For the purpose of comparison, commercially available bottled carbonated water (○) and carbonated water manufactured by an existing carbonated water manufacturing apparatus (●) were also tested. As evidenced by FIG. 21, carbonated water prepared by the above embodiment of carbonated water manufacturing apparatus according to the invention shows a high carbonic acid gas content level and retains the gas content for a prolonged period of time just as commercially available bottled carbonated water, whereas carbonated water prepared by a known manufacturing apparatus shows a high initial carbonic acid gas content level but loses the gas content quickly.

As described above in detail by referring to preferred embodiments, an apparatus for manufacturing carbonated water according to the invention can quickly produce carbonated water with a high carbonic acid gas content which does not easily lose carbonic acid gas and hence satisfactorily stimulates the throat with agreeable pungency.

Since an apparatus for manufacturing carbonated water according to the invention has a simple configuration, it is economic and effective and can suitably be used in an carbonated beverage supplying apparatus such as an automatic vending machine, an automatic dispenser or the like.

What is claimed is:

1. An apparatus for manufacturing carbonated water by contact between carbonic acid gas and water introduced into a carbonic acid gas pressure container said apparatus comprises, characterized in that said apparatus further comprises a mixing vessel arranged in the carbonic acid gas pressure container below the inlet port for introducing carbonic acid gas into the carbonic acid gas pressure container and the spray for introducing water into the carbonic acid gas pressure container and having the introduced water collide and become mixed with the water already in the pressure container, said mixing vessel being separated from the inner peripheral wall of the carbonic acid gas pressure container by a gap, in order for the sprayed water to be mixed with the water staying in the mixing vessel and a partition panel having an end rigidly secured to the inner peripheral wall of the carbonic acid gas pressure container and the opposite end extending close to the bottom of the mixing vessel so that the produced carbonated water passes through the gap between the partition panel and the peripheral wall of the mixing vessel and overflows the peripheral wall to flow down through the gap between the inner wall of the carbonic acid gas pressure container and the peripheral wall of the mixing vessel to the bottom of the carbonic acid gas pressure container.

2. An apparatus for manufacturing carbonated water according to claim 1, wherein the peripheral wall of the mixing vessel extends downward beyond the bottom of the mixing vessel.

3. An apparatus for manufacturing carbonated water according to claim 1, wherein water is discharged from the spray with a pressure higher than the predetermined pressure of carbonic acid gas in the carbonic acid gas pressure container by more than 3 $Kg/cm^2$.

4. An apparatus for manufacturing carbonated water according to claim 1, wherein a water level control sensor is arranged in the carbonic acid gas pressure container to detect the level of the carbonated water in the pressure container and produce a signal representing the level in order to control the water supply pump of the apparatus by referring to the upper limit water level, the lower limit water level and the critical water level for carbonated water.

* * * * *